US011008780B2

(12) United States Patent
Oxley et al.

(10) Patent No.: US 11,008,780 B2
(45) Date of Patent: May 18, 2021

(54) POWER DOOR PRESENTER WITH LATCHING FEATURE

(71) Applicant: Magna Closures Inc., Newmarket (CA)

(72) Inventors: Peter Lance Oxley, Mount Albert (CA); Kristopher B. Rogers, Etobicoke (CA)

(73) Assignee: MAGNA CLOSURES, INC., Newmarket (CA)

( * ) Notice: Subject to any disclaimer, the term of this patent is extended or adjusted under 35 U.S.C. 154(b) by 653 days.

(21) Appl. No.: 15/837,554

(22) Filed: Dec. 11, 2017

(65) Prior Publication Data

US 2018/0179788 A1 Jun. 28, 2018

Related U.S. Application Data

(60) Provisional application No. 62/438,573, filed on Dec. 23, 2016.

(51) Int. Cl.

| | |
|---|---|
| ***E05B 63/00*** | (2006.01) |
| ***E05C 17/20*** | (2006.01) |
| ***E05B 85/24*** | (2014.01) |
| ***E05F 15/60*** | (2015.01) |
| ***E05F 15/622*** | (2015.01) |
| ***E05B 81/12*** | (2014.01) |

(Continued)

(52) U.S. Cl.

CPC ..... *E05B 63/0004* (2013.01); *E05B 81/13* (2013.01); *E05B 81/20* (2013.01); *E05B 85/24* (2013.01); *E05C 17/203* (2013.01); *E05F 15/60* (2015.01); *E05F 15/622* (2015.01); *E05B 81/06* (2013.01); *E05B 81/78* (2013.01); *E05Y 2201/426* (2013.01); *E05Y 2900/531* (2013.01)

(58) Field of Classification Search

CPC . E04B 63/0004; E04B 81/20; E05Y 2201/426

See application file for complete search history.

(56) References Cited

U.S. PATENT DOCUMENTS

| | | | |
|---|---|---|---|
| 3,344,554 A | 10/1967 | Misaka et al. | |
| 4,183,177 A | 1/1980 | Kurdziel | |

(Continued)

FOREIGN PATENT DOCUMENTS

| | | |
|---|---|---|
| DE | 103 01 998 | * 3/2012 |
| EP | 0 310 993 | * 12/1989 |

*Primary Examiner* — Gregory J Strimbu

(74) *Attorney, Agent, or Firm* — Dickinson Wright PLLC

(57) ABSTRACT

A power door presenter system for pivoting a vehicle door relative to a vehicle body between a closed position and a partially open deployed position includes a presenter assembly mounted to one of the vehicle body and the vehicle door with an auxiliary striker fixed to the other one of the vehicle body and the vehicle door. The presenter assembly has an extensible member configured for movement between retracted and extended positions corresponding to the closed and deployed positions and an auxiliary latch mechanism moveable between latched engagement with the auxiliary striker when the vehicle door is indicated as not being under manual control of a user to allow automated return of the vehicle door to the closed position and unlatched engagement from the auxiliary striker when the vehicle door is indicated as being under manual control of the user to allow the door to be moved to a fully opened position.

10 Claims, 16 Drawing Sheets

(51) Int. Cl.

| | |
|---|---|
| ***E05B 81/20*** | (2014.01) |
| *E05B 81/06* | (2014.01) |
| *E05B 81/78* | (2014.01) |

(56) References Cited

U.S. PATENT DOCUMENTS

| | | | | |
|---|---|---|---|---|
| 5,228,239 | A | 7/1993 | Heo | |
| 5,369,911 | A | 12/1994 | Fortunato | |
| 7,688,179 | B2 | 3/2010 | Kurpinski et al. | |
| 8,326,497 | B2 | 12/2012 | Shahidi et al. | |
| 9,174,517 | B2 | 11/2015 | Scheuring et al. | |
| 10,087,671 | B2 * | 10/2018 | Linden | E05F 15/616 |
| 10,227,810 | B2 * | 3/2019 | Linden | E05B 81/58 |
| 2003/0111863 | A1 * | 6/2003 | Weyerstall | E05B 79/20<br>296/146.1 |
| 2008/0100092 | A1 | 5/2008 | Gao et al. | |
| 2014/0132135 | A1 * | 5/2014 | Becchi | A47L 15/4259<br>312/228 |
| 2014/0150581 | A1 * | 6/2014 | Scheuring | E05F 15/622<br>74/89.38 |
| 2015/0330116 | A1 | 11/2015 | Dente | |
| 2018/0038146 | A1 | 2/2018 | Linden et al. | |
| 2018/0038147 | A1 | 2/2018 | Linden et al. | |
| 2018/0051502 | A1 * | 2/2018 | Roos | E05B 81/34 |
| 2018/0106081 | A1 * | 4/2018 | Bendel | E05B 81/20 |
| 2019/0078361 | A1 * | 3/2019 | Worden | E05F 15/614 |

* cited by examiner

POWER DOOR PRESENTER WITH LATCHING FEATURE

CROSS-REFERENCE TO RELATED APPLICATION

This application claims the benefit of U.S. Provisional Application Ser. No. 62/438,573, filed Dec. 23, 2016, which is incorporated herein by reference in its entirety.

FIELD

The present disclosure relates generally to power door systems for motor vehicles and, more particularly, to a power door presenter operable for moving a vehicle door relative to a vehicle body between an open position and a closed position and an auxiliary latch assembly for holding the vehicle door in a partially-open position.

BACKGROUND

This section provides background information related to the present disclosure which is not necessarily prior art.

The passenger doors on motor vehicles are typically mounted by upper and lower door hinges to the vehicle body for swinging movement about a generally vertical pivot axis. Such swinging passenger doors ("swing doors") have recognized issues such as, for example, when the vehicle is situated on an inclined surface and the swing door either opens too far or swings shut due to the unbalanced weight of the door. To address this issue, most passenger doors have some type of detent or check mechanism integrated into at least one of the door hinges that functions to inhibit uncontrolled swinging movement of the door by positively locating and holding (i.e checking) the door in one or more mid-travel positions in addition to a fully-open position.

In view of increased consumer demand for motor vehicles equipped with advanced comfort and convenience features, many current vehicles are now provided with passive keyless entry systems to permit locking and release of the passenger doors without the use of traditional key-type manual entry systems. In this regard, some of the more popular features now provided with vehicle closure systems include power locking/unlocking and power release. These "powered" features are typically integrated into a primary latch assembly mounted to the passenger door and which is configured to include a latch mechanism, a latch release mechanism and at least one electric actuator. As is known, movement of the passenger door to its closed position causes the latch mechanism to engage a striker (mounted to the vehicle body) and shift the primary latch assembly into a latched mode. To subsequently release the passenger door for movement from its closed position toward an open position, an electric "power release" actuator can actuate the latch release mechanism to mechanically release the striker from the latch mechanism and shift the primary latch assembly into an unlatched mode.

As a further advancement, power door actuation systems have been developed which function to automatically swing the passenger door about its pivot axis between its open and closed positions. Typically, power door actuation systems include a power-operated device such as, for example, a power swing door actuator having an electric motor and a rotary-to-linear conversion device that are operable for converting the rotary output of the electric motor into translational movement of an extensible member. In many power door actuator arrangements, the power swing door actuator is mounted to the passenger door and the distal end of the extensible member is fixedly secured to the vehicle body. One example of a door-mounted power door actuation system is shown in commonly-owned U.S. Pat. No. 9,174,517 with a power swing door actuator having a rotary-to-linear conversion device configured to include an externally-threaded leadscrew rotatively driven by the electric motor and an internally-threaded drive nut meshingly engaged with the leadscrew and to which the extensible member is attached. Accordingly, control over the speed and direction of rotation of the leadscrew results in control over the speed and direction of translational movement of the drive nut and the extensible member for controlling swinging movement of the passenger door between its open and closed positions. Operation of the power swing door actuator is controlled in coordination with the power release operation of the primary latch assembly via the passive keyless entry system.

Some other door actuation systems, known as door presenter systems, are configured to include a power-operated door presenter assembly operable to "present" the door by opening it only a predetermined amount to a partially-open position so as to allow subsequent manual movement of the door to its fully-open position.

Because the door presenter assembly is typically activated by the passive keyless entry system in conjunction with power release of the primary latch assembly, it would be beneficial to have a door presenter system configured to fully close the vehicle door in the event the user decides, once the door is deployed, to not open it. It would also be beneficial to provide a door presenter system configured to hold the door by the power-operated door presenter assembly, to move the door between its deployed and rest positions, and allow manual or power release of a holding mechanism associated with the door presenter assembly. It is also desirous to overcome problems associated with current power door presenter systems in which the door can unintentionally open due to gravity forces and wind forces.

In view of the above, there remains a need to develop alternative power door presenter systems which address and overcome limitations associated with known power door actuation systems as well as to provide increased applicability while reducing cost and complexity.

SUMMARY

This section provides a general summary of the present disclosure and is not a comprehensive disclosure of its full scope or all of its features, aspects and objectives.

It is an aspect of the present disclosure to provide a power door presenter system for moving a vehicle door about a vertical axis between partially open, deployed position and closed positions relative to a vehicle body.

In a related aspect, the power door presenter system for a vehicle door includes providing a power door presenter unit, also referred to as assembly, having an auxiliary latch mechanism configured to latch the vehicle door in its deployed position. The auxiliary latch mechanism cooperates in conjunction with an auxiliary striker to selectively maintain the door in a latched condition during and/or upon deployment resulting from actuation of the power door presenter assembly. The auxiliary latch mechanism is selectively released (via preferably power or manual operation) prior to subsequent movement of the door to its fully open position.

In accordance with these and other aspects, a power door presenter system is provided for use in a motor vehicle having a vehicle body defining a door opening and a vehicle door pivotably connected to the vehicle body for movement about a vertical axis along a path between open and closed positions relative to the door opening.

In a non-limiting embodiment, the power door presenter system includes a power door presenter assembly attached to the vehicle body having a motor-driven actuator and an extensible member cooperating with a pivotable latch member (e.g. elongate hook mechanism) to selectively engage and retain a door-mounted auxiliary striker. An auxiliary latch release mechanism (manually or power operated) is arranged to selectively pivot the latch member between a striker capture position and a striker release position during and/or following movement of the door to its partially open, deployed position. A back-up release mechanism, such as a release cable connected to the door handle, can be used to pivot the door-mounted striker between a latched position and a released position. As such, release of the auxiliary latch striker by the power door presenter system can provide for coordinated and controlled presentment of door by the power door presentment system while also subsequently providing for manual opening of the door by the user. Further, by disabling the engagement between the power door presenter system and the auxiliary latch striker, the door can be manually opened by the user without having a door presentment feature.

In a further non-limiting embodiment, the power door presenter system includes a presenter assembly having a housing mounted to one of the vehicle body and the vehicle door and having an extensible member and an actuator for actuating movement of the extensible member between a retracted position corresponding to the closed position of the vehicle door and an extended position corresponding to the partially open deployed position of the vehicle door, with the presenter assembly having an auxiliary latch mechanism moveable between latched and unlatched positions. An auxiliary latch striker is fixed to the other one of the vehicle body and the vehicle door, with the auxiliary latch striker being configured to be selectively latched with the auxiliary latch mechanism when the auxiliary latch mechanism is in the latched position, and unlatched from the auxiliary latch mechanism when the auxiliary latch mechanism is in the unlatched position. The auxiliary latch mechanism is selectively operable to be unlatched from the auxiliary latch striker when the vehicle door is indicated as being under manual control of a user, so as to permit movement of the door from the partially open deployed position to a fully open position, and the auxiliary latch mechanism is selectively operable to be latched with the auxiliary latch striker when the vehicle door is indicated as not being under manual control of a user while in the partially open deployed position, so as to permit return movement of the door to the closed position via movement of the extensible member to the retracted position.

In accordance with a further aspect, the auxiliary latch mechanism can be provided to be operable to remain in the latched position in latched engagement with the auxiliary latch striker during powered movement of the extensible member between the retracted and extended positions and be moved to the unlatched position and unlatched from the auxiliary latch striker when the vehicle door is indicated as being under manual control of a user.

In accordance with a further aspect, a control module can be configured in operable communication with the presenter assembly. The control module can be configured to receive a signal from a sensor and to provide a signal to the presenter assembly indicating the vehicle door is under manual control of the user to release the auxiliary latch mechanism from latched engagement with the auxiliary latch striker.

In accordance with a further aspect, the auxiliary latch mechanism can be configured to remain in latched engagement with the auxiliary latch striker while the door is in the partially open deployed position in the absence of receiving a signal indicating the vehicle door is under manual control of the user from the control module.

In accordance with a further aspect, the control module can be configured to be operable to send a signal to the presenter assembly to return the extensible member to the retracted position while the auxiliary latch mechanism is in latched engagement with the auxiliary latch striker to return the door to the closed position.

In accordance with a further aspect, the auxiliary latch mechanism can be configured to be operable to remain in the unlatched position in unlatched engagement from the auxiliary latch striker during powered movement of the extensible member between the retracted and extended positions and can be configured to be further operable to be moved to the latched position into engagement with the auxiliary latch striker when the vehicle door reaches the partially open deployed position, so as to permit subsequent retraction of the door to the closed position under control of the presenter unit.

In accordance with a further aspect, the auxiliary latch mechanism can be pivotally connected to the extensible member for mechanized, pivotal movement between the latched and unlatched positions, and can further include a biasing member maintaining the auxiliary latch mechanism in one of the latched and unlatched positions absent an externally applied force.

In accordance with a further aspect, the auxiliary latch mechanism can further include at least one auxiliary member abutment surface fixed thereto and at least one presenter abutment surface fixed to the housing, with at least one auxiliary member abutment surface being configured for selective abutment with the at least one presenter abutment surface to pivot the auxiliary latch mechanism between the latched and unlatched positions against a bias of the biasing member.

In accordance with a further aspect, the at least one presenter abutment surface can include first and second presenter abutment surfaces fixed to the housing, with the first presenter abutment surface being configured to abut the auxiliary member abutment surface to pivot the auxiliary latch mechanism from the unlatched position to the latched position while the extensible member is in the retracted position and with the second presenter abutment surface being configured to abut the auxiliary member abutment surface to pivot the auxiliary latch mechanism from the unlatched position to the latched position while the extensible member is in the extended position.

In accordance with a further aspect, a power door presenter system for pivoting a vehicle door relative to a vehicle body between a closed position and a partially open deployed position includes a presenter assembly having a housing mounted to one of the vehicle body and the vehicle door and having an extensible member and an actuator for actuating movement of the extensible member between retracted and extended positions, with an auxiliary latch striker fixed to the other one of the vehicle body and the vehicle door. The auxiliary latch striker is configured to be in unlatched engagement from the presenter assembly during powered movement by the presenter assembly of the door from the closed position to the partially open deployed position. An auxiliary latch mechanism is configured to be operable for selective engagement with the auxiliary latch striker when the vehicle door is in the partially open deployed position, so as to provide automated movement of the door to the closed position under selective actuation of the actuator and corresponding movement of the extensible member from the extended position to the retracted position.

In accordance with yet a further aspect, a power door presenter system for pivoting a vehicle door relative to a vehicle body between a closed position and a partially open deployed position includes a presenter assembly having a housing mounted to one of the vehicle body and the vehicle door and having an extensible member and an actuator for actuating movement of the extensible member between retracted and extended positions, with an auxiliary latch striker being fixed to the other one of the vehicle body and the vehicle door. The auxiliary latch striker is configured to be in latched engagement with the presenter assembly upon powered movement by the presenter assembly of the door from the closed position to the partially open deployed position. An auxiliary latch mechanism is configured to be operable for releasing the presenter member from the latched engagement with the auxiliary latch striker when the vehicle door is in the partially open deployed position, so as to permit movement of the door from the partially open deployed position to a fully open position when under control of the user.

In accordance with the disclosed embodiments, the door presenter assembly functions, at least in part: to provide door movement from a door closed position to a preferred door deployed position within a predetermined range of swinging motion; to allow unlatching of the auxiliary latching mechanism from an auxiliary striker in order to move the door from its deployed position to its fully open position after a voluntary action (e.g. power release by triggering a release sensor or manually actuating the release cable); to allow the auxiliary latching mechanism to be re-engaged with the auxiliary striker to facilitate returning the door from the deployed position to the closed position; to allow the door presenter to be retracted from deployed position; and to allow the auxiliary latching mechanism to be re-engaged with the presenter unit upon closing the door. It is recognized that the presenter assembly can be deployed in conjunction with either a cinch enabled or non-cinch enabled primary latch.

BRIEF DESCRIPTION OF THE DRAWINGS

Other advantages of the present disclosure will be readily appreciated, as the same becomes better understood by reference to the following detailed description when considered in connection with the accompanying drawings wherein:

FIG. 7 is a flowchart for operation of the power door presenter system of

FIG. 2;

DETAILED DESCRIPTION OF EXAMPLE EMBODIMENTS

In general, example embodiments of a power door actuation system and presenter assembly therefor constructed in accordance with the teachings of the present disclosure will now be disclosed. The example embodiments are provided so that this disclosure will be thorough, and will fully convey the scope to those who are skilled in the art.

Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, will-known device structures, and well-known technologies are described in detail.

Figure 1A:
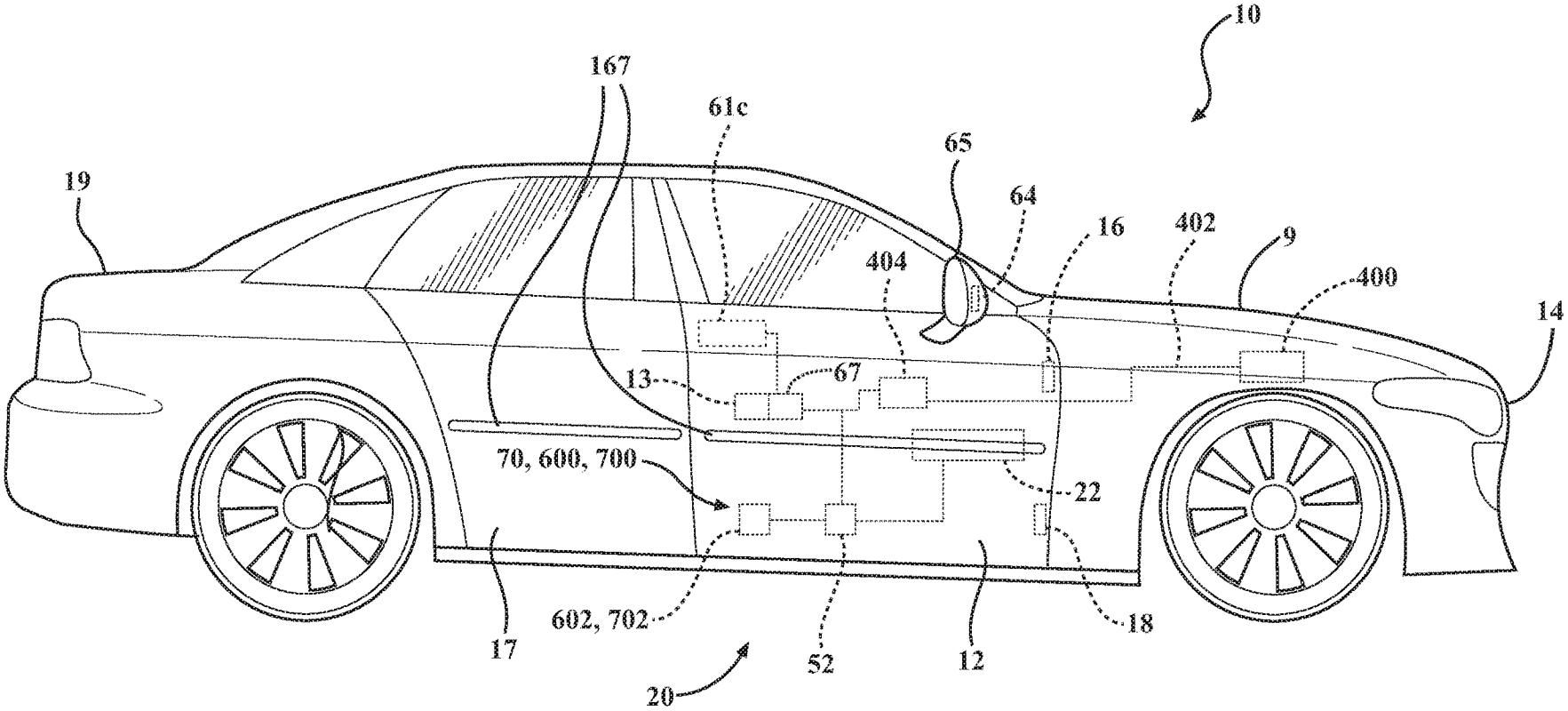
FIG. 1A illustrates an example motor vehicle equipped with a power door presenter system situated between a front passenger swing door and a vehicle body and which is configured to include a compact power door presenter assembly.

Referring initially to FIG. 1A, an example motor vehicle 10 is shown to include a first passenger door 12 pivotally mounted to a vehicle body 14 via an upper door hinge 16 and a lower door hinge 18 which are shown in phantom lines. In accordance with the present disclosure, a power door actuation system 20 is associated with the pivotal connection between first passenger door 12 and vehicle body 14. In accordance with a preferred configuration, power door actuation system 20 includes a power door presenter system 70, a swing vehicle door ECU 52, a primary latch assembly 13, and can also be configured with a power-operated swing door actuator 22 secured within an internal cavity of passenger door 12 for coordinated control of the opening and closing of the door 12. The motor vehicle 10 illustrated in FIG. 1A may be provided as not including outside vehicle door handles on the vehicle door 12, and also in an alternate embodiment, outside door handles may be provided, an example of which is described herein below and illustrated in FIG. 1B.

Figure 1B:
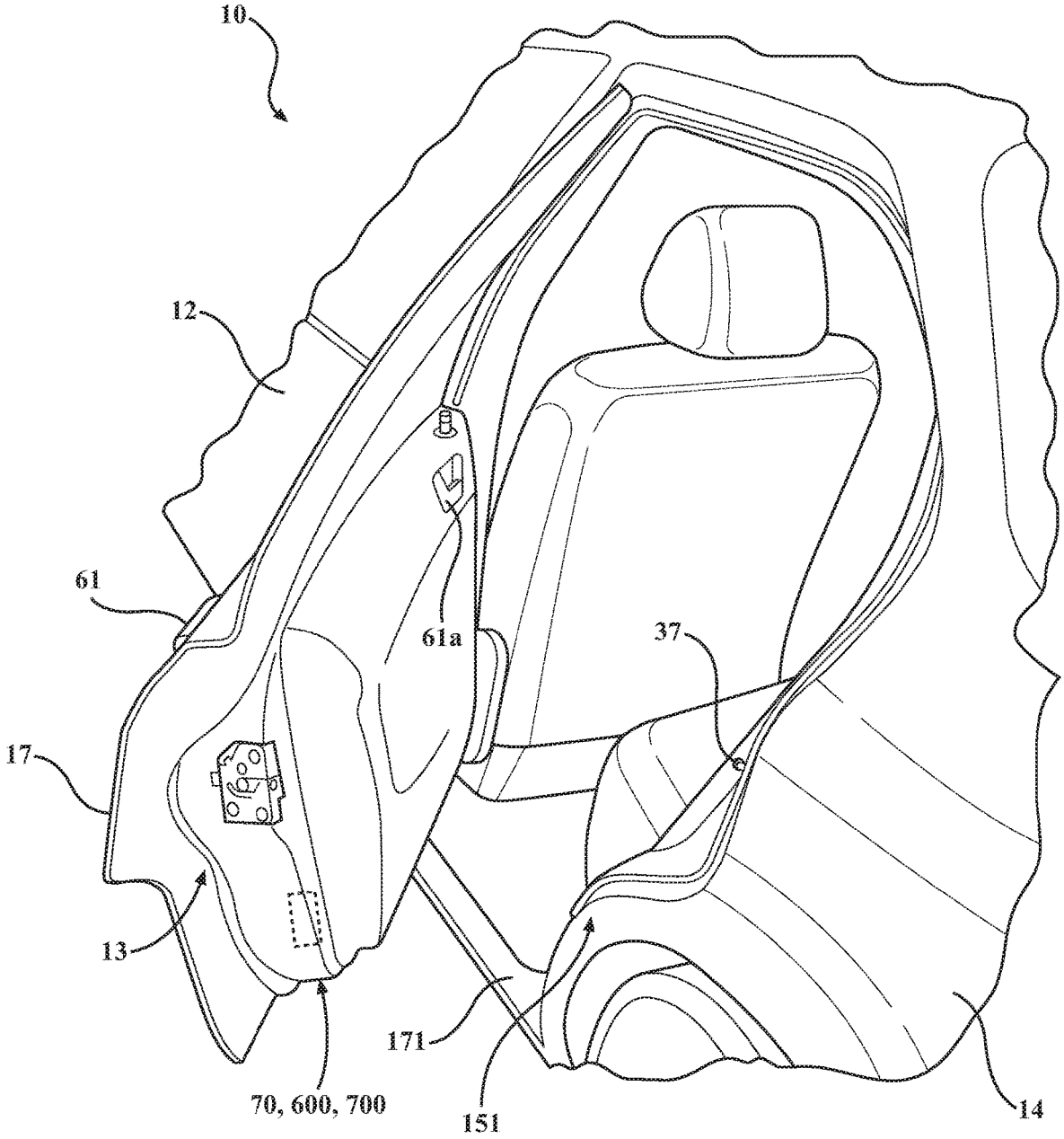
FIG. 1B is a partial perspective view showing a primary latch assembly and a compact power door presenter system installed in a passenger swing door associated with the vehicle of FIG. 1A.

Each of upper door hinge 16 and lower door hinge 18 include a door-mounting hinge component and a body-mounted hinge component that are pivotably interconnected by a hinge pin or post. While power door actuation system 20 is only shown in FIG. 1A in association with front passenger door 12, those skilled in the art will recognize that the power door actuation system 20 can also be associated with any other door, such as rear passenger doors 17, as shown in FIG. 1B, or also be associated with a lift gate (not shown), a hood 9, or a deck lid 19. Also, while the door 12 is illustrated herein as being pivotally mounted to the vehicle body 14 for rotation relative to a vertical axis, it may be configured for rotation about a horizontal axis as would be the case for a lift gate, or other offset axis, or the like. For greater clarity, the vehicle body 14 is intended to include the 'non-moving' structural elements of the vehicle 10 such as the vehicle frame, structural support pillars and members, and body panels.

Figure 1C:
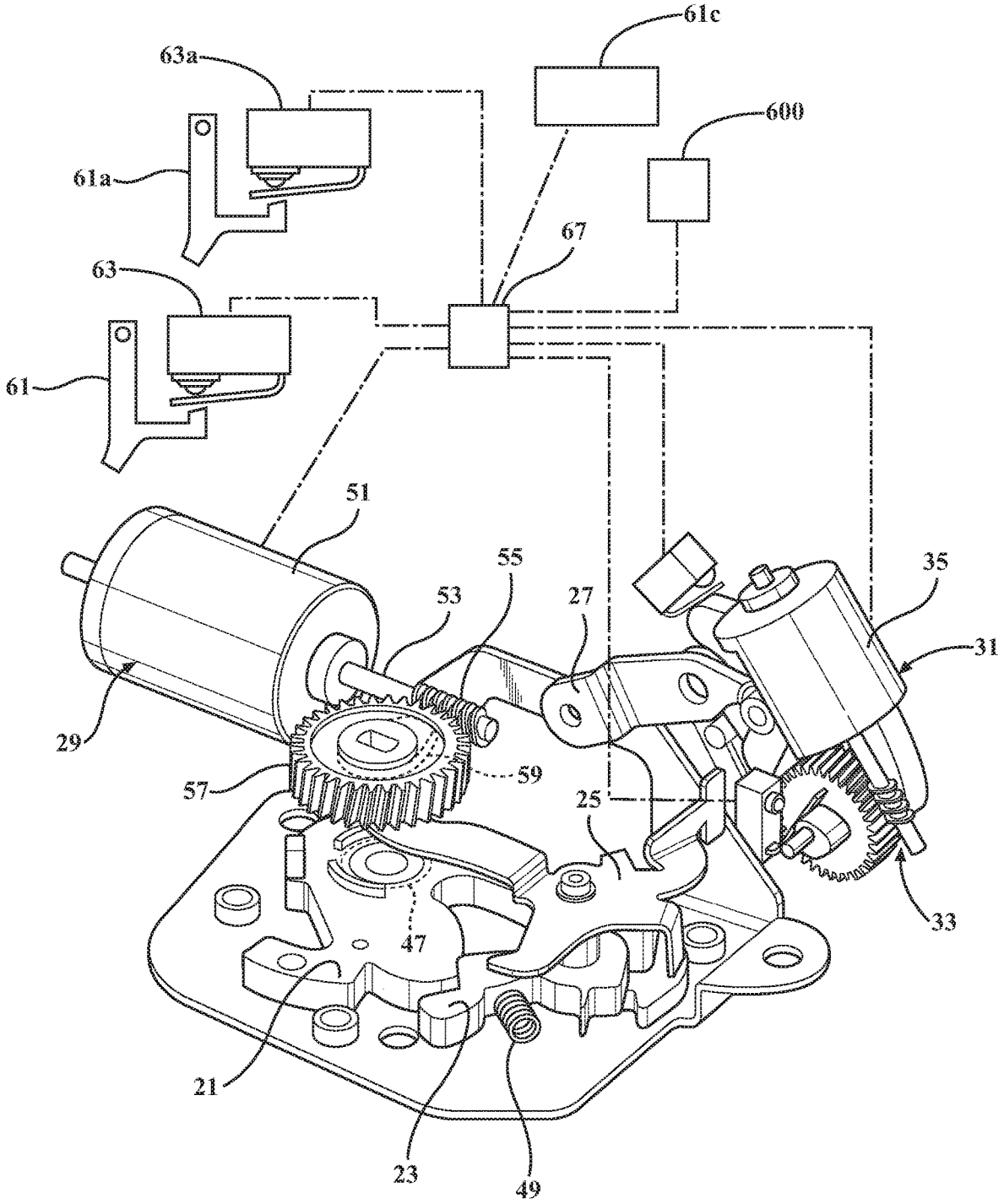
FIG. 1C illustrates an example embodiment of the primary latch assembly of FIG. 1B.

Referring to FIGS. 1B and 1C, shown is a non-limiting embodiment of a primary closure latch assembly 13 for vehicle doors 12, 17 of vehicle 10. Closure latch assembly 13 can be positioned on vehicle door 12, 17 and arranged in a suitable orientation to engage a primary first striker, referred to hereafter as striker 37, mounted on vehicle body 14, when door 12, 17 is closed. Closure latch assembly 13 includes a latch mechanism having a ratchet 21 and a pawl 23, a latch release mechanism having a pawl release lever 25, an inside door release mechanism having an inside release lever 27, a power release actuator 29 for controlling powered actuation of the latch release mechanism, and a power lock actuator 31 having a lock mechanism 33 and an electric lock motor 35. Ratchet 21 is movable between two striker capture positions including primary or fully closed position (shown in FIG. 1C) and secondary or partially closed position (not shown) whereat ratchet 21 retains striker 37, and a striker release position (FIG. 1B) whereat ratchet 21 permits release of striker 37 from a fishmouth provided by a latch housing of primary latch assembly 13.

Referring to FIG. 1C, a ratchet biasing member 47, such as a spring, is provided to normally bias ratchet 21 toward its striker release position. Pawl 23 is movable between a ratchet holding position (FIG. 1C) whereat pawl 23 holds ratchet 21 in its striker capture position, and a ratchet releasing position whereat pawl 23 permits ratchet 21 to move to its striker release position. A pawl biasing member 49, such as a suitable spring, is provided to normally bias pawl 23 toward its ratchet holding position.

Pawl release lever 25 is operatively connected to pawl 23 and is movable between a pawl release position whereat pawl release lever 25 moves pawl 23 to its ratchet releasing position, and a home position whereat pawl release lever 25 permits pawl 23 to remain in its ratchet holding position. A release lever biasing member (not shown), such as a suitable spring, is provided to normally bias pawl release lever 25 toward its home position. Pawl release lever 25 can be moved to its pawl release position by several components, such as, for example, by power release actuator 29 and by inside door release lever 27. Power release actuator 29 includes a power release motor 51 having an output shaft 53, a power release worm gear 55 mounted on output shaft 53, and a power release gear 57. A power release cam 59 is connected for rotation with power release gear 57 and is rotatable between a pawl release range of positions and a pawl non-release range of positions. In FIG. 1C, power release cam 59 is located in a position that is within the pawl non-release range. Power release gear 57 is driven by worm gear 55 for driving cam 59 which, in turn, drives pawl release lever 25 from its home position into its pawl release position.

Power release actuator 29 can be used as part of a conventional passive keyless entry feature. When a person approaches vehicle 10 with an electronic key fob 60 (FIG. 2) and actuates an outside door handle 61, for example, sensing both the presence of key fob 60 and that door handle 61 has been actuated (e.g. via communication between a switch 63 (FIG. 1C) and an electronic latch control unit (ECU) 67 (FIG. 1C) that at least partially controls the operation of closure latch assembly 13). In turn, latch ECU 67 actuates power release actuator 29 to cause the latch release mechanism to release the latch mechanism and shift primary closure latch assembly 13 into an unlatched operating state so as to facilitate subsequent opening of vehicle door 12. Power release actuator 29 can be alternatively activated as part of a proximity sensor based entry feature (radar based proximity detection for example), for example when a person approaches vehicle 10 with an electronic key fob 60 (FIG. 2) and actuates a proximity sensor 61*c*, such as a capacitive sensor, or other touch/touchless based sensor (based on a recognition of the proximity of an object, such as the touch/swipe/hover/gesture or a hand or finger, or the like), (e.g. via communication between the proximity sensor 61*c* (FIG. 1C) and electronic latch control unit (ECU) 67 (FIG. 1C) that at least partially controls the operation of closure latch assembly 13). In turn, latch ECU 67 actuates power release actuator 29 to cause the latch release mechanism to release the latch mechanism and shift primary closure latch assembly 13 into an unlatched operating state so as to facilitate subsequent opening of vehicle door 12. Also, power release actuator 29 can be used in association with power door actuation systems 20 and door presenter applications, as further describe below.

Power door actuation system 20 can include power-operated swing door actuator 22 having the features of being typically mounted in door 12 and located near door hinges 16, 18; providing for full open/close movement of door 12 under actuation; providing an infinite door check function; and providing for manual override (via a slip clutch) of power-operated swing door actuator 22 as desired. Power operated swing door actuator 22 can function to automatically swing passenger door 12 about its pivot axis between its open and closed positions. Typically, power-operated swing door actuator 22 can include a power-operated device such as, for example, an electric motor and a rotary-to-linear conversion device that are operable for converting the rotary output of the electric motor into translational movement of an extensible member. In many power door actuation arrangements, the electric motor and the conversion device are mounted to passenger door 12 and a distal end of the extensible member is fixedly secured to vehicle body 14.

Figure 2:
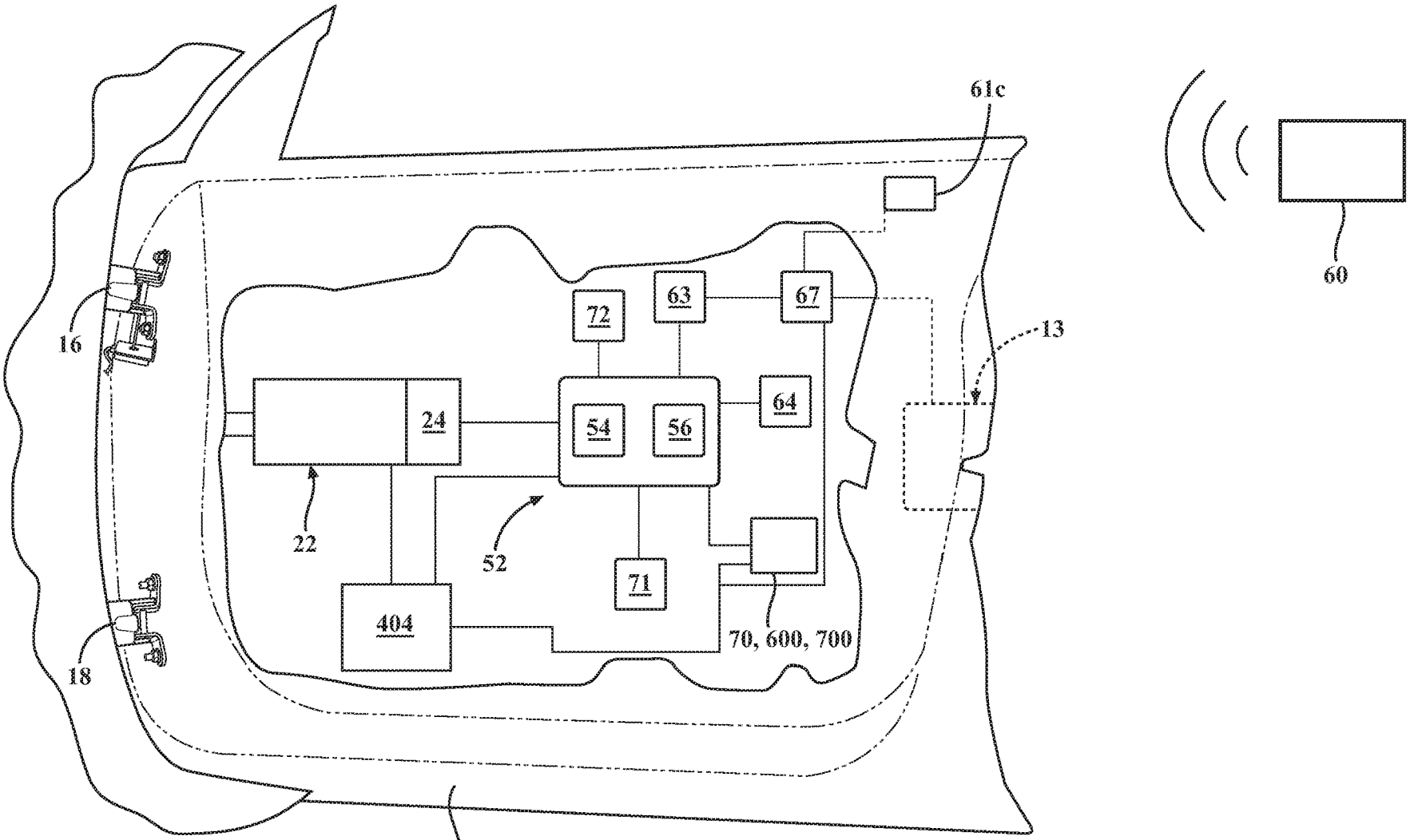
FIG. 2 is a diagrammatic view of the front passenger door shown in FIG. 1A, with various components removed for clarity purposes only, in relation to a portion of the vehicle body and which is equipped with the power door presenter system in accordance with one aspect of the disclosure.

Referring to FIGS. 1A and 2, in accordance with preferred configurations, power door presenter system 70 (which can be configured for door 12 in conjunction with power-operated swing door actuator 22) generally includes a power-operated door presenter assembly 602 secured within an internal cavity (e.g. preferably of vehicle body 14, or of passenger door 12, for example, and therefore associated with door 12) and including an electric motor driving a drive mechanism having an extensible component. Driven rotation of the drive mechanism causes controlled translation of the extensible component which, in turn, controls pivotal movement of passenger door 12 relative to vehicle body 14. The power-operated door presenter system 70 cooperates with an auxiliary striker latch assembly, referred to hereafter as auxiliary striker 604, via a first embodiment of a power door presenter system 600. It is to be recognized that location of the power-operated door presenter systems 70, 600 between vehicle body 14 and vehicle door 12 can be at any position, as shown by example or otherwise, as desired.

Accordingly, the presenter assembly of power door presenter system 70, 600 as further explained below, can be located at the bottom of door 12 below primary latch assembly 13 opposite to door hinges 16, 18. Alternatively, the presenter assembly of power door presenter system 70, 600 can be mounted to vehicle body 14, for example at the base of the rear body pillar (such installation in the pillar 151 or sill/rocker panel 171 can provide increased packaging space for the presenter assembly) and an auxiliary latch/striker mechanism of power door presenter system 70, 600 can be mounted to door 12. Power door presenter system 70, 600 can also provide for a partial open/close movement of door 12. As such, actuation of power door presenter system 70, 600 can provide for coordinated and controlled presentment of door 12 by power door presenter system 70, 600 while also subsequently providing for release of the auxiliary striker 604 and manual opening of door 12 by the user.

As also shown, an electronic control module, hereinafter referred to as swing door ECU 52, is in communication with electric motor 24 for providing electric control signals thereto. Swing door ECU 52 can include a microprocessor 54 and a memory 56 having executable computer readable instructions stored thereon.

FIG. 2 shows one or more sensors 71 communicating with swing door ECU 52 for providing requisite information. It is recognized that sensors 71 can be any number of sensor types (e.g. Hall sensor, presence sensors such as anti-pinch strips, capacitive, ultrasonic, mechanical switches, location sensors, etc.). Although not expressly illustrated, electric motor 24 can include sensors for monitoring a position of vehicle door 12 during movement between its open and closed positions. As is also schematically shown in FIG. 2, swing door ECU 52 can be in communication with remote key fob 60 or an internal/external handle switch 63*a*, 63 for receiving a request from a user to open or close vehicle door 12. Put another way, swing door ECU 52 receives a command signal from either remote key fob 60 and/or internal/external handle switch 63*a*, 63 to initiate an opening or closing of vehicle door 12. It is also recognized that a body control module 72 (having memory with instructions for execution on a computer processor) mounted in body 14 of vehicle 10 can send the open or close request to swing door ECU 52 and electronic latch ECU 67.

It is recognized that other than outside handle switch 63, swing door ECU 52 can be in communication with a number of other sensors in the vehicle including in power-operated swing door actuator 22, in power door presenter system 70, 600 and in primary latch assembly 13. For example, the switches of primary latch assembly 13 can provide information to latch ECU 67 as well as swing door ECU 52 (i.e. the switches provide positional information to swing door ECU 52 of the location/state of door 12 with respect to position at or between the fully closed or latched position, secondary or partially closed and the partially open or unlatched position). Obviously a single ECU can be used to integrate the functions of swing door ECU 52 and latch ECU 67 into a common control device located anywhere within door 12.

Swing door ECU 52 can also receive an additional input from a (e.g. ultrasonic) sensor 64 positioned on a portion of vehicle door 12, such as on a door mirror 65, or the like. Ultrasonic sensor 64 assesses if an obstacle, such as another car, tree, or post, is near or in close proximity to vehicle door 12. If such an obstacle is present, ultrasonic sensor 64 will send a signal to swing door ECU 52, and swing door ECU 52 will proceed to turn off electric motor 24 to stop movement of vehicle door 12, and thus prevent vehicle door 12 from hitting the obstacle.

Figure 3A:
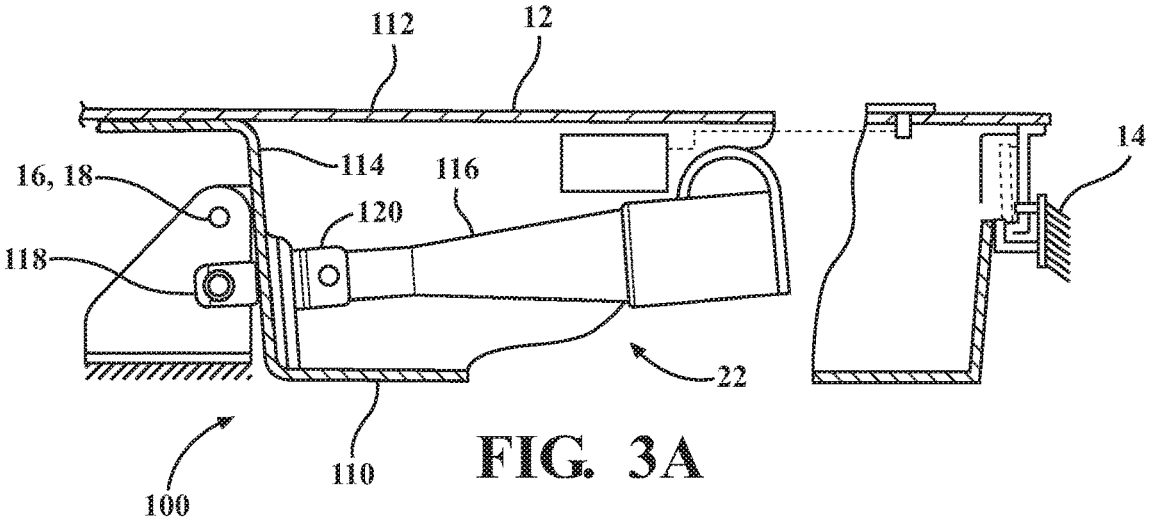
FIG. 3A is a schematic view of a power swing door actuator according to one aspect of the disclosure which is operably arranged between the vehicle body and the swing door for moving the swing door between a closed position, as shown in FIG. 3A, to one or more partially-open positions, as shown in FIG. 3B, and a fully-open position, as shown in FIG. 3C.
Figure 3B:
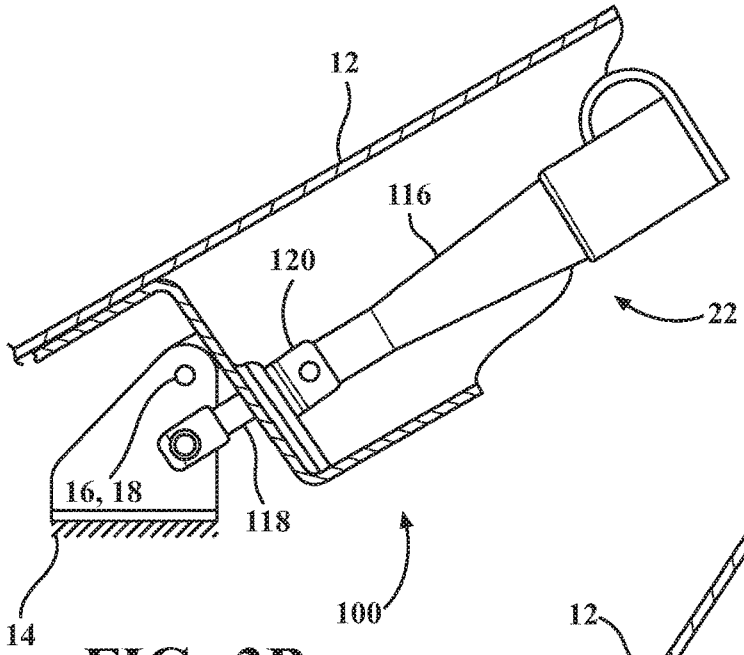
Figure 3C:
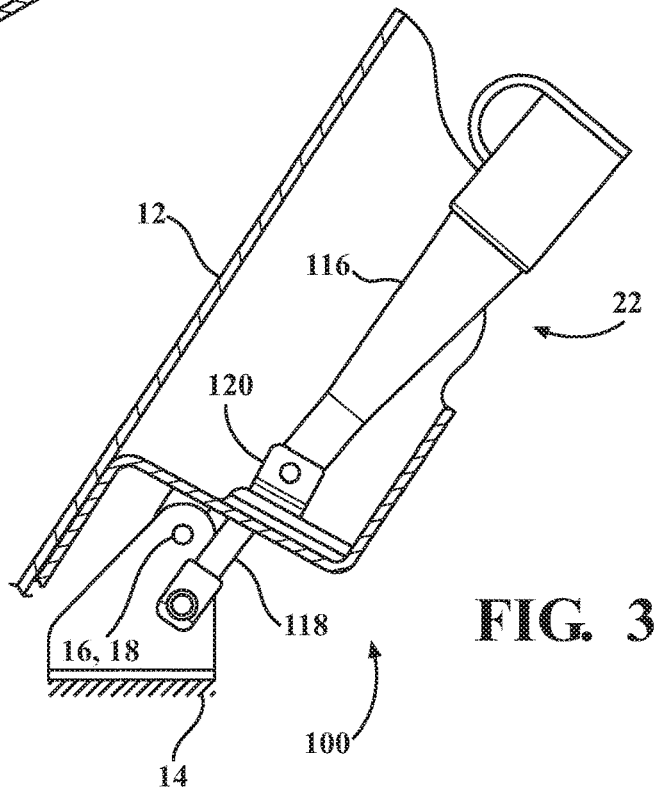

FIGS. 3A, 3B and 3C show an embodiment of a power swing door assembly 100 including power swing door actuator 22 in operation to move vehicular swing door 12 between a closed position, a mid-position, and an open position, respectively. The swing door 12 includes inner and outer sheet metal panels 110 and 112 with a connecting portion 114 between the inner and outer sheet metal panels 110 and 112. The power swing door actuator 22 has a housing 116 and an extensible member 118. The extensible member 118 is moveable between extended and retracted positions relative to housing 116. The power swing door assembly 100 may be mounted between the inner and outer sheet metal panels 110, 112, where the actuator housing 116 is fixed to the swing door via a bracket 120 mounted to the connecting door portion 114. The extensible member 118 is mounted to the vehicle body 106.

Figure 4:
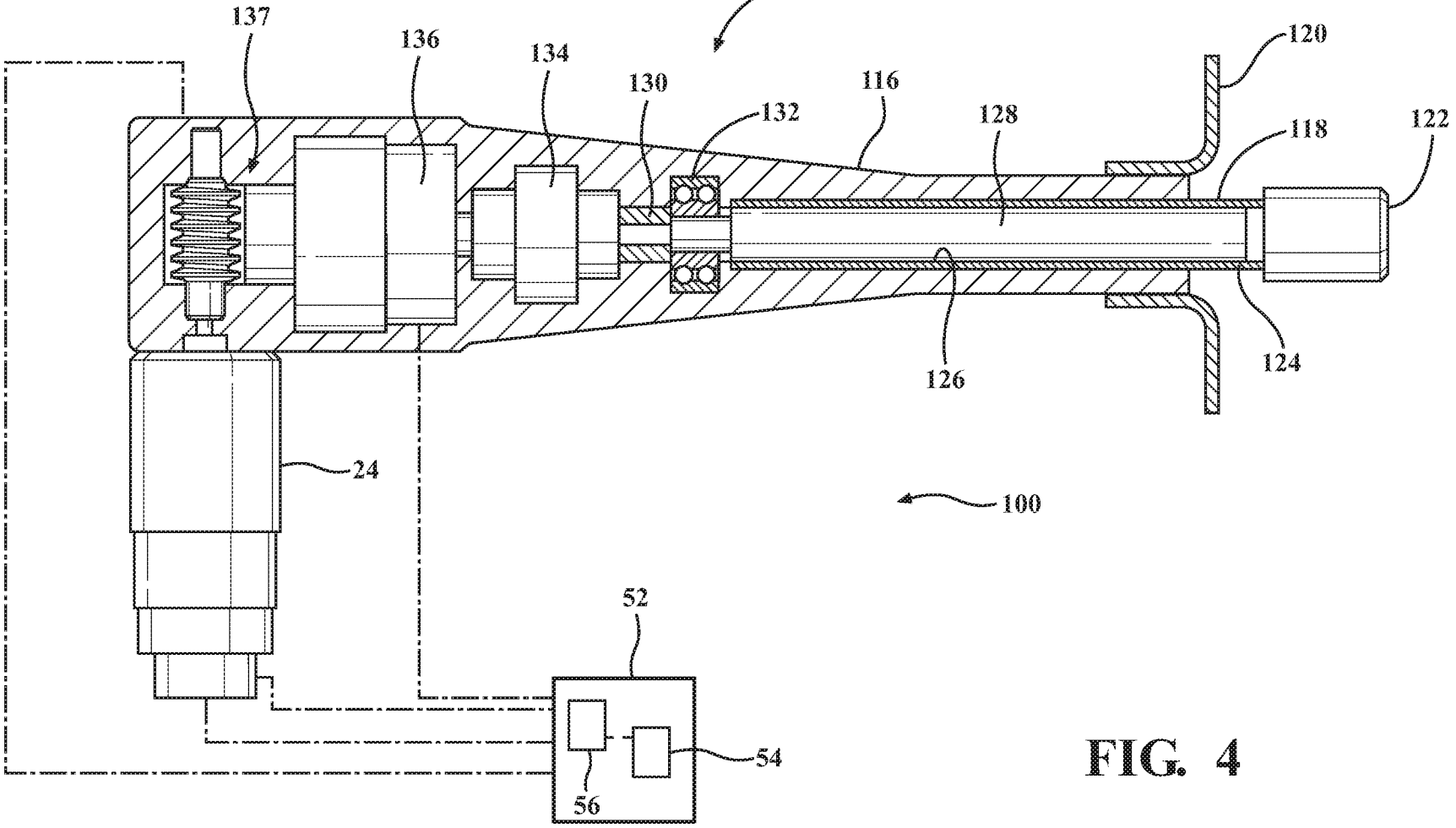
FIG. 4 is a sectional view of the power swing door actuator shown in FIGS. 3A, 3B and 3C.

Referring additionally to the cross-sectional view of the power swing door assembly 100 in FIG. 4, the housing 116 defines a cylindrical chamber in which the extensible member 118 slides. The extensible member 118 has a ball socket 122 at an external end thereof for attachment to the vehicle body 14. The ball socket 122 is connected to a cylindrical tube member 124 which has an internal thread 126 proximate an internal end of the extensible shaft 118.

The internally threaded member 124 may be a cylindrical tube with an internal thread (and may be referred to as a nut tube) meshingly engages with a lead screw 128 mounted in the housing for rotation in situ. The lead screw 128 is mateable with the internally threaded member 124 to permit relative rotation between lead screw 128 and the internally threaded member 124. In the embodiment shown, because the nut tube 124 is slidably connected in the housing 116 but is prevented from rotation, as the lead screw 128 rotates the nut tube 124 translates linearly, causing the extensible member 118 to move with respect to the housing 116. Since the extensible member 118 is connected to the vehicle body 14 and the housing 116 is connected to the swing door 12, movement of the extensible housing causes the swing door 12 to pivot relative to the vehicle body 14. The lead screw 128 and the nut tube 124 define a spindle-type rotary-to-linear conversion mechanism.

The lead screw 128 is rigidly connected to a shaft 130 that is journaled in the housing 116 via ball bearing 132 that provides radial and linear support for the lead screw 128. In the illustrated non-limiting embodiment, an absolute position sensor 134 is mounted to the shaft 130. The absolute position sensor 134 as known in the art translates lead screw rotations into an absolute linear position signal so that the linear position of the extensible member 118 is known with certainty, even upon power up. In alternative embodiments, the absolute linear position sensor 134 can be provided by a linear encoder mounted between the nut tube 124 and housing 116 which reads the travel between these components along a longitudinal axis.

The shaft 130 is connected to a slip clutch unit 136. The slip clutch unit 136 is normally engaged and is energized to disengage. In other words, the slip clutch unit 136 couples the lead screw 128 with a gear train unit 137 without the application of electrical power and the slip clutch unit 136 requires the application of electrical power to uncouple the lead screw 128 from the gear train unit 137. The slip clutch unit 136 may engage and disengage using any suitable type of clutching mechanism, such as a set of sprags, rollers, a wrap-spring, a pair of friction plates, or any other suitable mechanism. As such, the slip clutch 136 can be used in the power door presenter assemblies to inhibit abuse loading of the electric motor of the power door presentment system 70, 600 (e.g. in the event that obstacles by the door 12 are encountered during operation of the electric motor of the power door presentment system 70, 600).

Now referring back to FIG. 1A, the power door actuation system 20 and the primary closure latch assembly 13 are electrically connected to a main power source 400 of the motor vehicle 10, for example a main battery providing a battery voltage $V_{batt}$ of 12 V, through an electrical connection element 402, for example a power cable (the main power source 400 may equally include a different source of electrical energy within the motor vehicle 10, for example an alternator). The electronic latch ECU 67 and/or swing door ECU 52 are also coupled to the main power source 400 of the motor vehicle 10, so as to receive the battery voltage $V_{batt}$, the electronic latch ECU 67 and/or swing door ECU 52 are thus able to check if the value of the battery voltage $V_{batt}$ decreases below a predetermined threshold value, to promptly determine if an emergency condition (when a backup energy source may be needed) occurs.

As shown in the schematic block diagram of FIG. 1A and FIG. 2, a backup energy source 404, which may be integrated forming part of an electronic control circuit of the electronic latch ECU 67 and/or swing door ECU 52, or may be separate therefrom, is configured to supply electrical energy to the power door actuation system 20 and/or the primary closure latch assembly 13, and to the same electronic control circuit of the electronic latch ECU 67 and/or swing door ECU 52, in case of failure or interruption of the main power supply from the main power source 400 of the motor vehicle 10.

In an illustrative example, the backup energy source 404 includes a group of low voltage supercapacitors (not shown) as an energy supply unit (or energy tank) to provide power backup to the power door actuation system 20 and/or the primary closure latch assembly 13, even in case of power failures. Supercapacitors may include electrolytic double layer capacitors, pseudocapacitors or a combination thereof. Other electronic components and interconnections of a backup energy source 404, such as a boost module to increase the voltage from the backup energy source 404 to an actuator, such as the power door presenter system 70, 600 for example, are disclosed in co-owned patent application US2015/0330116, which is incorporated herein by way of reference in its entirety.

A first non-limiting embodiment of power door presenter system 600 will now be described with reference to FIGS. 5A-5C (illustrating a progressive door opening sequence) and to FIGS. 6A-6C (illustrating a progressive door closing sequence) to generally include a power door presenter assembly 602. In general, power door presenter assembly 602 is adapted to be rigidly secured to one of the vehicle body 14 or the vehicle door 12, such as by securing a housing 610 of the power presenter assembly 602 thereto, as will be further described herein below.

Referring to FIGS. 5A-6C, a non-limiting embodiment of the power door presenter system 600 is shown, such that the power door presenter system 600 can be mounted to the vehicle body 14 as arranged to be generally aligned with a B pillar structure of vehicle body 14, by way of example and without limitation. The power door presenter system 600 can include power door presenter assembly 602 and auxiliary latch assembly 604. Presenter assembly 602 is configured as a power-operated actuator 603 including a motor-driven spindle mechanism having an electric motor 601 (similar to the electric motor 24 of FIG. 2) driving a reduction gear train for rotatably driving an externally-threaded lead screw 618 (similar to the drive mechanism of FIG. 4). An extensible member 622 (e.g. comprised of an internally-threaded nut 623) and a striker abutment 621 is non-rotatably and axially moveable on lead screw 618 between a retracted position (FIG. 5A) and an extended position (i.e. presented position; FIG. 5C). When extensible member 622 is retracted, vehicle door 12 is consider closed such that striker 37 is engaged with the primary latch 13 in the primary or secondary closed position (see FIGS. 1A, 1C). In contrast, when extensible member 622 is extended, door 12 is in a partially open deployed position, also referred to as "presented" position (FIG. 5C). Extensible member 622 can move through a controlled range of bi-directional axial travel to permit corresponding movement of door 12 relative to vehicle body 14. The power swing door actuation system 600 can also incorporate a slip clutch similar to the slip clutch unit 136 shown in FIG. 4.

Auxiliary latch assembly 604 can comprise an auxiliary second striker, referred to hereafter as auxiliary striker 624, connected to the door 12, which is aligned for engagement (FIGS. 6A and 6B) or disengagement (FIGS. 5A-5C and 6C) with an auxiliary latch mechanism, shown in a non-limiting embodiment as an elongate latch member, and referred to hereafter as latch hook 630. Latch hook 630 is pivotally connected between its opposite ends to the extensible member 622 via a pivot member, such as a pivot pin, and also referred to hereafter as pivot 632. As such, the latch hook 630 moves axially in conjoint relation with the extensible member 622. A biasing member or element 611 (e.g. spring) can bias and maintain the latch hook 630 in a disengaged position with respect to the auxiliary striker 624, absent suitable externally applied force sufficient to overcome the bias imparted by the biasing element 611. At positions of the extensible member 622 shown in FIGS. 5A-5C and 6C, the biasing element 611 maintains rotation of the latch hook 630 about pivot 632 such that the latch hook 630 is aligned for disengagement from the auxiliary striker 624. Accordingly, when the latch hook 630 is in a disengaged position such that the latch hook 630 does not act to restrict movement of the door 12 or otherwise act on the door 12. The sequence of movement illustrated in FIG. 5A-5C shows a progression of the door 12 being opened from a closed position (FIG. 5A) to the partially opened "presented" position (FIG. 5C). When in the presented position (FIG. 5C), the door 12 remains free to be fully opened without restriction from the latch hook 630, wherein the swing door actuator 22 could take over and bring the door 12 to its fully open position in automated fashion, if desired, or otherwise the door 12 could be manually opened by the user. However, if the door 12 is not opened via automation or manually from the presented position (FIG. 5C), such as within a predetermined and programmed amount of time, by way of example and without limitation, the latch hook 630 can be selectively brought into hooked engagement with the auxiliary striker 624 to facilitate acting on the door 12 to return the door 12 to the closed position.

Figure 5A:
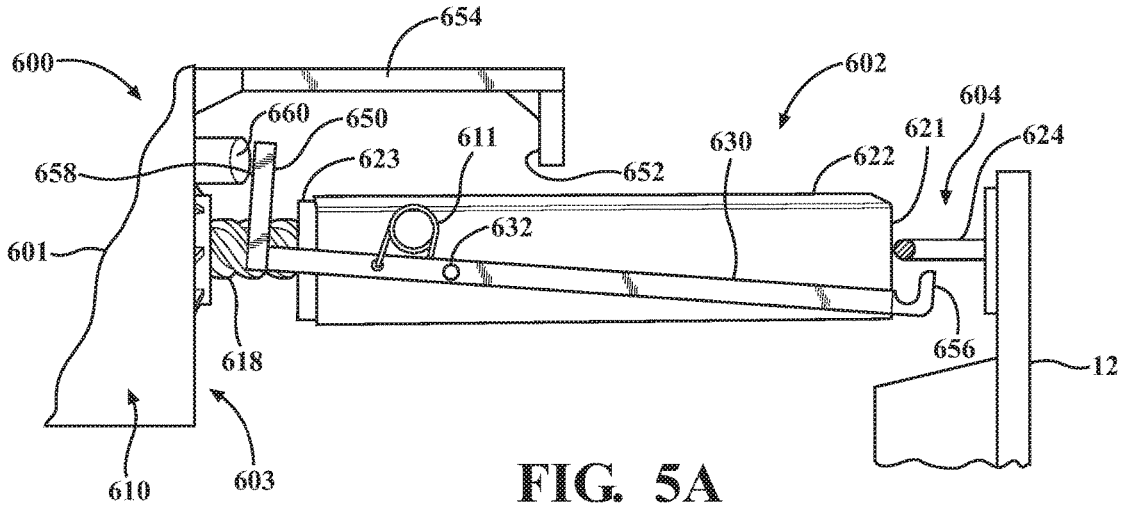
FIG. 5A is an operational view of a presenter assembly of the auxiliary latching mechanism associated with the power door presenter system shown in FIG. 2 showing the presenter assembly in a retracted position of a door opening sequence.
Figure 5B:
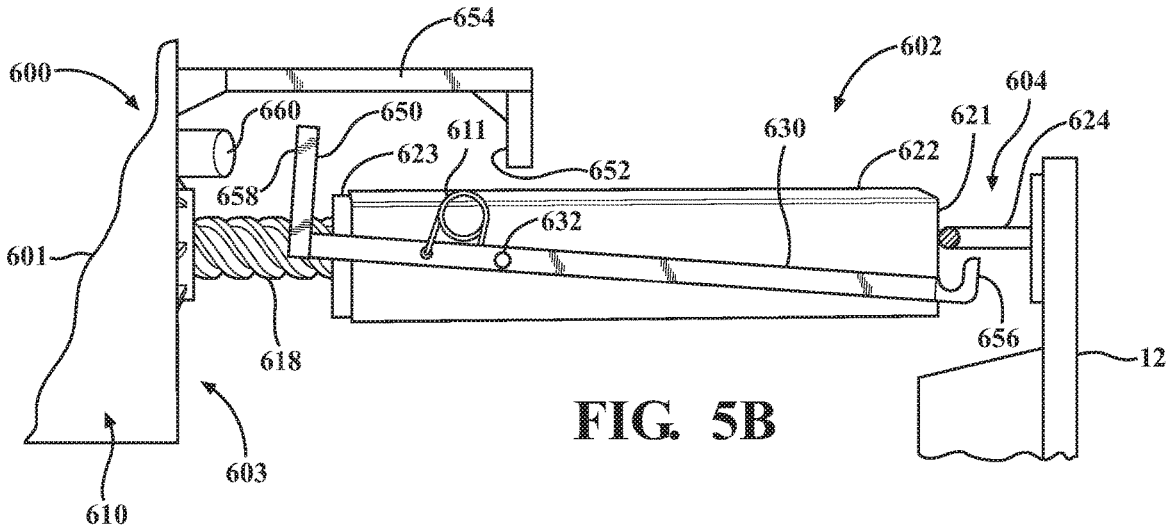
FIG. 5B is a view similar to FIG. 5A showing the presenter assembly in a partially presented position of the door opening sequence.
Figure 5C:
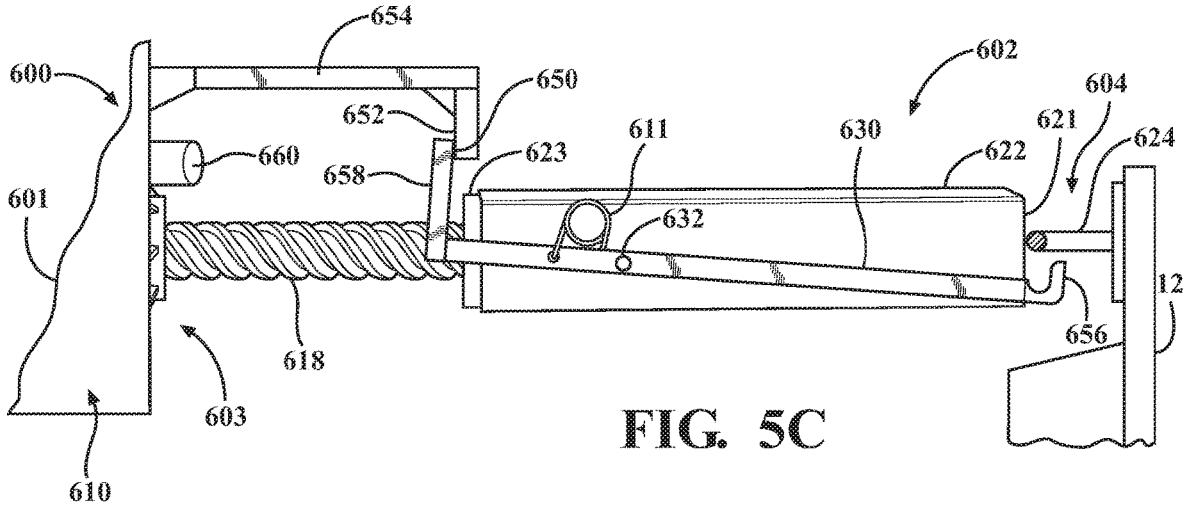
FIG. 5C is a view similar to FIG. 5A showing the presenter assembly in a fully presented position of the door opening sequence.
Figure 6A:
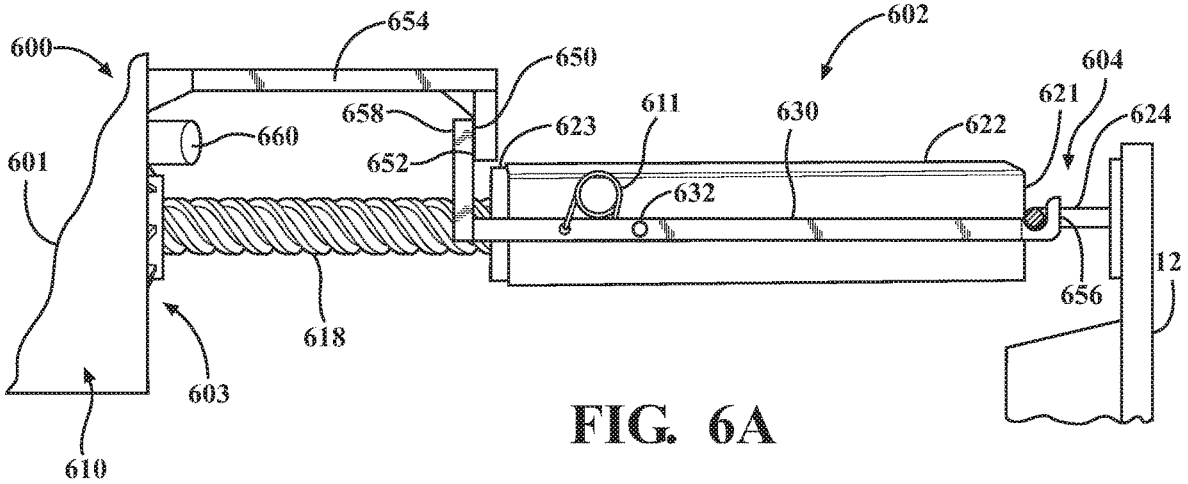
FIG. 6A is an operational view of the presenter assembly of the auxiliary latching mechanism associated with the power door presenter system shown in FIG. 2 showing the presenter assembly in an initial stage of a door closing sequence.

To bring the latch hook 630 into operable engagement with the auxiliary striker 624, the extensible member 622 can be further extended axially outwardly from the vehicle body 14 (i.e. towards the door 12), slightly beyond the position shown in FIG. 5C, via rotation of the lead screw 618 to cause the latch hook 630 to be pivoted about pivot member 632 from the disengaged position of the latch hook 630 shown in FIG. 5A to an engaged position shown in FIG. 6A. The pivoting movement of the latch hook 630 is facilitated via contact of a first auxiliary member abutment surface 650 (of the latch hook 630) with a first presenter abutment surface 652 of elongate arm 654 (connected to and extending from the actuator housing 610) which causes rotation of the latch hook 630 about pivot 632 (against spring bias of the biasing element 611) in order to engage a hook portion 656 of latch hook 630 with the auxiliary striker 624. For example, a profile of the hook portion 656 can be used to maintain engagement (i.e. resist bias of biasing element 611) between the hook portion 656 and the auxiliary striker 624 during retraction of the extensible member 622 from the latch engagement position of FIG. 6A to the secondary door latch position of FIG. 6B. In other words, the biasing element 611 (e.g. toggle spring or any suitable spring member, by way of example and without limitation) can be used to hold the hook portion 656 in the striker engaged position. Further retraction of the extensible member 622 causes a second auxiliary member abutment surface 658 of the latch hook 630 to confront and contact a second presenter abutment surface 660 positioned on and extending outwardly from the housing 610, thus causing pivoting movement of the latch hook 630 about the pivot 632 (against the bias of the biasing element 611) to cause disengagement between the auxiliary striker 624 and the hook portion 656.

As shown in FIG. 6A, the latch hook 630 can engage with the auxiliary striker 624, such as at full extension of the extensible member 622, and is disengaged with the auxiliary striker 624, such as at full retraction of the extensible member 622. As such, selective engagement of the latch hook 630 with the auxiliary striker 624 provides for closing of the door 12 from an open position to a secondary latched position (i.e. signifying engagement of the striker 624 of the door 12 and the conventional primary door latch 13. As noted, cinching of the primary latch 13 via cinching mechanism can close the door 12 by returning the primary latch 13 from the secondary closed position to the primary closed position. In the alternative, it is recognized that the primary latch 13 can be configured without a cinch feature, thereby providing for closure of the door 12 from an open position to the primary closed position of the primary latch 13 with respect to the striker 37.

Referring to FIGS. 2, 5A-6C and 7, discussed is an example operation of the non-limiting embodiment of the power swing door actuation system 600. As shown, the electronic control module 52 is in communication with electric motor 601 of system 70, 600 for providing electric control signals thereto. Electronic control module 52 can include the microprocessor 54 and the memory 56 having executable computer readable instructions stored thereon for implementing the control logic stored as a set of computer readable instructions in the memory 56 for operating the power door presenter system 600. In an embodiment, the electronic control module 52 may be integrated into the power swing door actuation system 600, as well as a LIN Controller.

Shown by example, electric motor 601 can include sensors 71 (e.g. Hall-effect) for monitoring a position and speed of vehicle door 12 during movement between its open and closed positions. For example, one or more Hall-effect sensors 71 may be provided and positioned on the power door presenter system 70, 600 to send signals to electronic control module 52 that are indicative of rotational movement of electric motor 601 and indicative of the rotational speed of electric motor 601, e.g., based on counting signals from the Hall-effect sensor 71 detecting a target on a motor output shaft. In situations where electronic control module 52 is in a power open or power close mode and the Hall-effect sensors 71 indicate that a speed of electric motor 601 is less than a threshold speed (e.g. zero) and a current spike is registered, electronic control module 52 can determine that an obstacle is in the way of vehicle door 12, in which case the electronic control system can take any suitable action, such as sending a signal to turn off electric motor 601. As such, electronic control module 52 can receive feedback from the Hall-effect sensors 71 to provide that a contact obstacle has not occurred during movement of vehicle door 12 from the closed position to the open position, or vice versa. It is also recognized that the sensors 71 can include proximity and/or presence sensors (e.g. detecting the presence of a hand of the user), in order to detect that the user has manual control of the door 12 (e.g. is holding the door 12).

As is also schematically shown in FIG. 2, electronic control module 52 can be in communication with the remote key fob 60, the main vehicle control module (also referred to as the body control module BCM 72), or the internal/external handle switch 63*a*, 63 for receiving a request from a user to open or close vehicle door 12. Put another way, electronic control module 52 receives a command signal from at least one of the remote key fob 60, BCM 72, and/or internal/external handle switch 63*a*, 63 to initiate an opening or closing of vehicle door 12. In one embodiment, operation of the remote key fob 60 (BCM 72 or external door handle 61) by the user can act as the signal to the control module 52 to release the primary latch 13 and then start operation and extension of the extensible member 622 via the electric motor 601. Operation of the internal handle 61*a* of the door 12 by the user can be regarded by the control module 52 as a signal to release the power door presenter system 600 from the auxiliary latch assembly 604, shown as the auxiliary striker 624, and maintain the power door presenter system 600 in a retracted or home state position during opening of the door 12 by the user from inside of the vehicle 10.

Upon receiving a command, electronic control module 52 can provide a signal to electric motor 601 in the form of a pulse width modulated voltage (for speed control) to turn on motor 601 and initiate pivotal swinging movement of vehicle door 12 towards its partially open deployed position (recognizing that the primary latch 13 is already in a release state as further discussed below) via extension of the extensible member 622. During extension of the extensible member 622, and while the striker abutment 621 is engaged with the auxiliary striker 624, the auxiliary latch mechanism, shown as the latch hook 630, remains disengaged and unlatched from the auxiliary striker 624. While providing the signal, electronic control module 52 can also obtain feedback from the sensors 71 to indicate that contact with an obstacle has not occurred or otherwise that the user is present (e.g. is manually in charge of the door 12). If no obstacle is present, motor 601 will continue to generate a rotational force sufficient to actuate spindle drive mechanism and thus continue axial extension of the extensible member 622 until certain door positions are reached (e.g. 50 mm open position) or otherwise indicate that the user is present (e.g. hand is on the partially open door 12). Once vehicle door 12 is positioned at the desired partially open presented position (FIG. 5C), motor 601 is automatically turned off. At this stage, the latch hook 630 remains disengaged and unlatched from the auxiliary striker 624, thereby allowing manual or power assisted (i.e. via swing door actuator 22) movement of the door 12 to a further opened position. If, however, the user does not take control of the door 12, then a signal can be sent to further actuate spindle drive mechanism and continue axial extension of the extensible member 622 toward the door 12 to bring the first auxiliary member abutment surface 650 into engagement with the first presenter abutment surface 652, thereby causing the latch hook 630 of the auxiliary latch mechanism to pivot about the pivot member 632 to bring the hook portion 656 into hooked engagement with the auxiliary striker 624 (FIG. 6A). As such, with the latch hook 630 coupled in joined relation with the auxiliary striker 624, a signal to retract the extensible member 622 can be sent, thereby causing the vehicle door 12 to be automatically pulled closed again by the electronic control module 52 via the door presenter system 600, as further described below.

Electronic control module 52 can also receive an additional input from the sensor 64 positioned on a portion of vehicle door 12, such as on the door mirror 65, or the like. Sensor 64 assesses if an obstacle, such as another car, tree, or post, is near or in close proximity to vehicle door 12. If such an obstacle is present, sensor 64 will send a signal to electronic control module 52, and electronic control module 52 will proceed to turn off electric motor 601 to stop movement of vehicle door 12, and thus inhibit vehicle door 12 from hitting the obstacle. This provides a non-contact obstacle avoidance system. In addition, or optionally, an obstacle avoidance system can be placed in vehicle 10 which can include a contact sensor 66 mounted to the door 12, such as in association with the molding component 167, and operable to send a signal to the controller 52.

Figure 7:
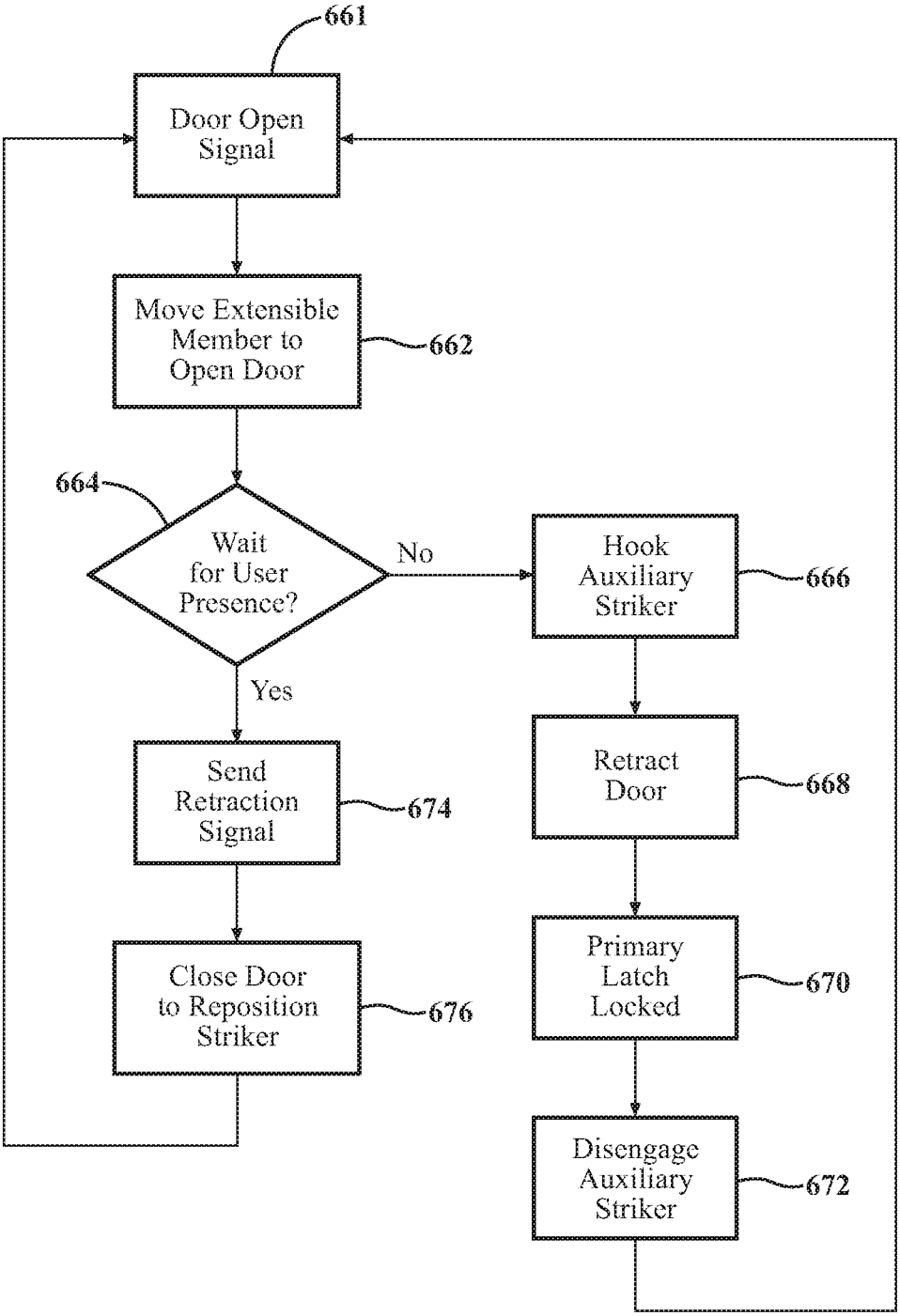

Referring to FIG. 7, at step 661, the control module 52 receives a signal for opening of the door 12. If the signal is indicative of coming from inside of the vehicle 10 (e.g. via internal door handle/button 61*a* operation), the door 12 is operated manually as a conventional door 12, as the electric motor 601 is not actuated and the power door presenter system 600 remains in the de-energized, disengaged state (FIG. 5A), thus facilitating opening of the door 12 manually by the user from inside. If the signal is indicative of coming from outside of the vehicle 10 (e.g. via operation or presence of key fob 60), the control module 52 at step 662 signals the electric motor 601 for operation such that the extensible member 622 extends axially outwardly and moves the door 12 outboard from the position of FIG. 5A to the position shown at FIG. 5C (e.g. to a first check link detent position measured at approx. 50 mm from the B-pillar to the trailing edge of the door 12) by pushing on the door 12 (e.g. as shown pushing on the auxiliary striker 624 positioned in abutment with striker abutment 621 of the extensible member 622). This provides for the elimination of the need for outside handles if desired. It is recognized that the primary latch 13 can be operated by control module 52 (or by another vehicle control module—not shown) to become unlatched (e.g. placed into the unlatched position such that the latch pawl 23 is disengaged from the ratchet 21) prior to operation of the power door presenter system 600, thus facilitating opening movement (i.e. presentment) of the door 12 by the power door presenter system 600 when the primary latch 13 is in the released state. It is also recognized that the latch pawl 23 can be maintained in the disengaged position (the power release motor 601 is not "reset" or returned to the home position) until the extensible member 622 has opened the door 12 over sufficient travel such that the ratchet 21 is disengaged from the striker 37 (i.e. the door 12 is in open position). It is recognized that other than the handle switch 63, 63*a*, the electronic control module 52 can be in communication with a number of other switches 71 in the primary latch 13. For example, the switches 71 of the primary latch 13 can provide information to the control module 52 of the door 12 position (i.e. the switches 71 provide positional information to the control module 52 of the location/state of the door 12 with respect to position at or between the fully closed or latched position and the fully open or unlatched position). In other words, the control module 52 is aware of the door 12 position (primary vs. secondary vs. closed) from the position switches 71 of (e.g. inside) the primary latch 13.

Once presented (FIG. 5C), at step 664, the control module 52 waits for a specified period of time (it is to be recognized that the specified period of time can be programmed as desired) to receive a signal from the sensor(s) 71 representing that the user has control (e.g. is manually moving) of the door 12. In this case, the sensors 71 can be preferably an anti-pinch strip type sensor that runs the periphery of the door and is activated by contact when manually grabbing the door, by way of example and without limitation. If no signal (e.g. change of state) is received from the sensors 71, then the control module 52, at step 666, as discussed above, sends a signal to engage the latch hook 630 with the auxiliary striker 624, for example by signaling the electric motor 601 for operation such that the extensible member 622 moves the door 12 slightly outboard from the position of FIG. 5C (sufficiently for the respective abutment surfaces 650, 652 to abut one another and pivot the latch hook 630) to the position shown at FIG. 6A (e.g. whereupon latch hook 630 engages with the auxiliary striker 624 on the door 12). At step 668, the control module 52 signals the electric motor 601 to retract the extensible member 622 (while the latch hook 630 and striker 624 are engaged) in order to pull the door 12 to the secondary latch position (FIG. 5B), for example. At step 670, the primary latch 13 cinching mechanism can close the door 12 and the door 12 is returned to the primary closed position of FIG. 6C at step 672 whereby disengagement of the latch hook 630 with the striker 624 occurs via confronting abutment of the respective abutment surfaces 658, 669 with one another causing pivoting movement of the latch hook 630 about pivot member 632. Alternatively, the extensible member 622 can pull the door 12 to the primary closed position (FIG. 6C). Accordingly, the power door presenter system 600 is reset and ready for reactivation at step 661.

Figure 6B:
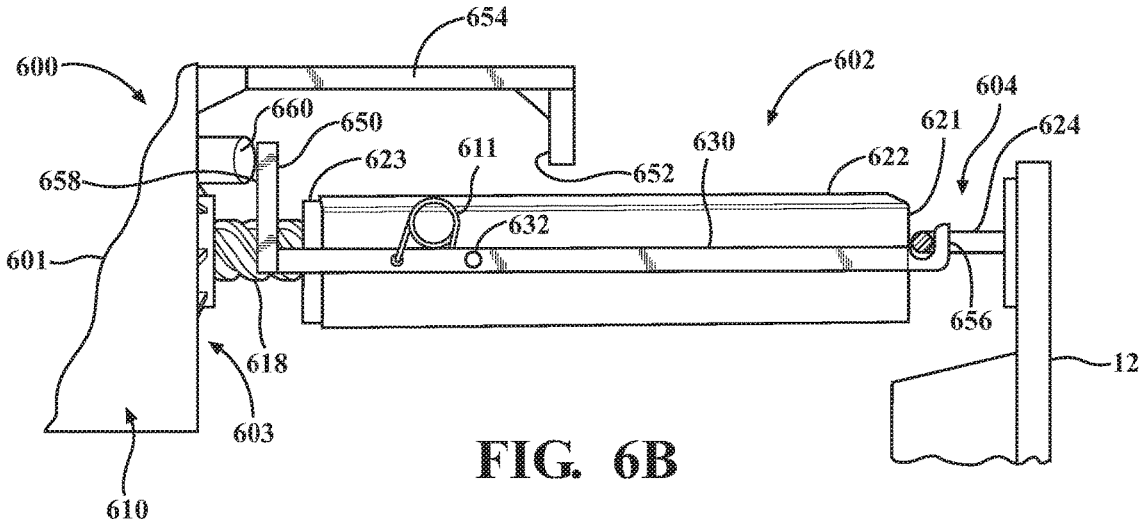
FIG. 6B is a view similar to FIG. 6A showing the presenter assembly in an intermediate stage of the door closing sequence.
Figure 6C:
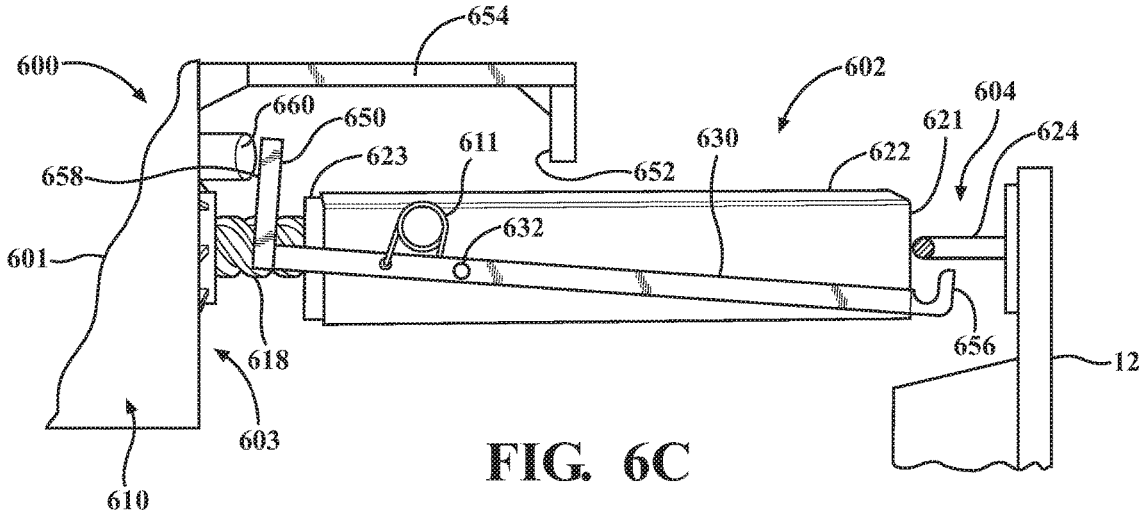
FIG. 6C is a view similar to FIG. 6A showing the presenter assembly in a final stage of the door closing sequence.

Otherwise, if at step 664 the sensor(s) 71 provide a signal at step 674 to the control module 52 that the door 12 is under the manual control of the user, then a change of state is detected (i.e. operator opens door) and the control module 52 sends a retraction signal to the electric motor 601 in order to fully retract the extensible member 622 to its home position (i.e. shown in FIG. 6C wherein the latch hook 656 is disengaged from the striker 624 while the door 12 is in the fully open state). Upon closing of the door 12 by the user (e.g. manually) in order to close the primary latch 13, the auxiliary striker 624 would once again become positioned at step 676 adjacent to the extensible member 622 to resemble as shown in FIG. 6C or 5A. Accordingly, the power door presenter system 600 is reset and ready for reactivation at step 661.

Figure 8:
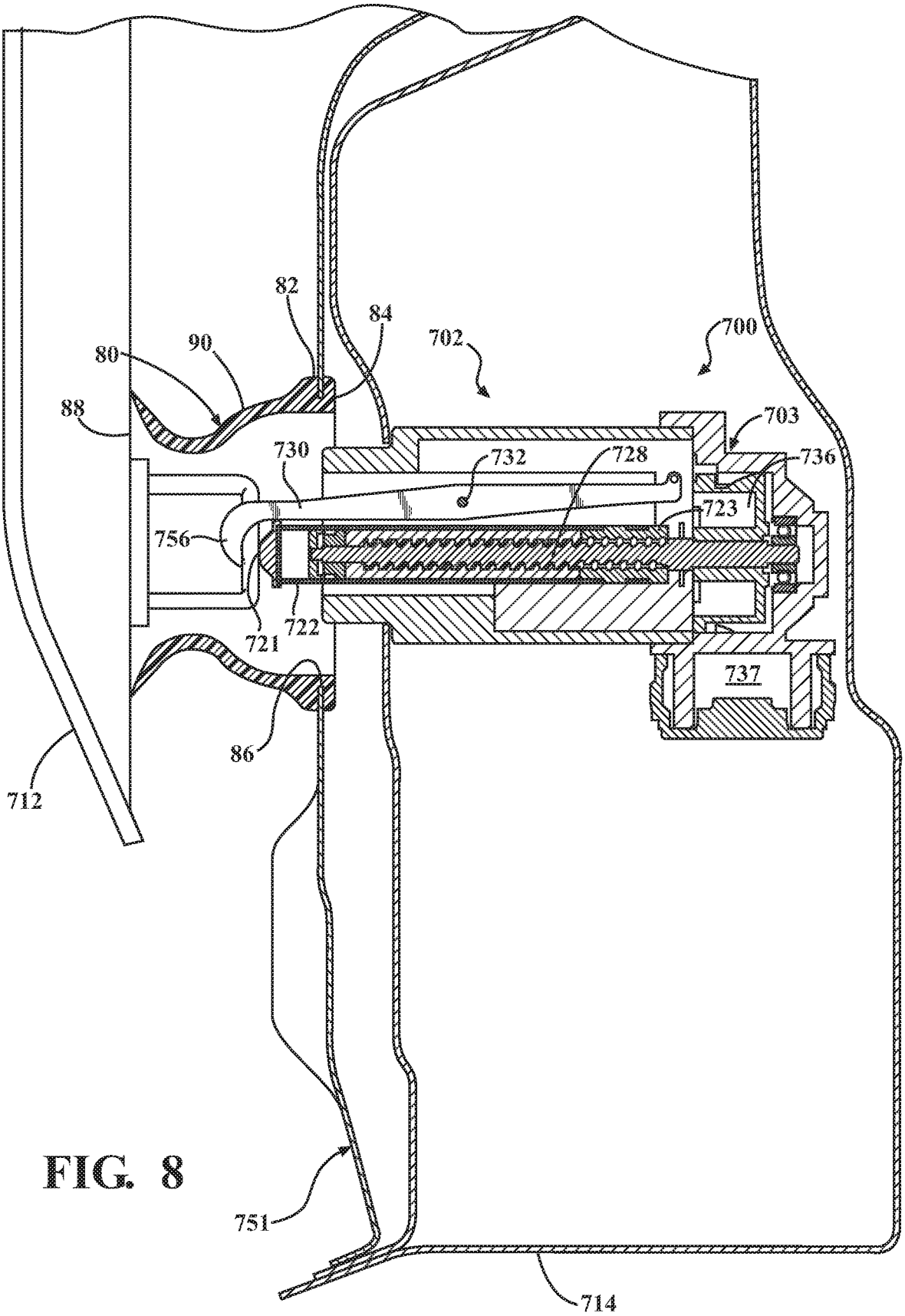
FIG. 8 is an alternative embodiment of a presenter assembly of the power door presenter system of FIG. 2.

Referring to FIG. 8, shown is a further embodiment of a power door presenter system 700, wherein the same reference numerals as used above for the power door presenter system 600 are used, offset by a factor of 100, to identify like features. The power door presenter system 700 includes a presenter assembly 702, shown by way of example as being mounted to a vehicle body 714, and further shown in a non-limiting example as being mounted to a pillar 751, including an actuator 703 which can have the basic components of the motor 701, the gearing 737, the slip clutch unit 736, the drive mechanism (including the extensible member 722 supported for linear translation via selective rotation of a leadscrew 728 and nut 723, with the extensible member 722 also being referred to as a push tube). The extensible member 722 has a bumper or striker abutment 721 located on a distal end of the extensible member 722. It is recognized that the distal end of the extensible member 722 can also be used as the indirect connection to auxiliary striker 724. As such, contact between the extensible member 722 (e.g. using an auxiliary latch mechanism, shown in the form of a pivotal member, such as a latch hook 730 having a hook portion 756 cooperating striker abutment 721, by way of example and without limitation) and the auxiliary striker 724 is used to extend or retract the door 12 in conjunction with axial movement of the extensible member 722 via actuation of the electrical motor 701, wherein any suitable slip clutch, as discussed above, can provide protection against damage to the electric motor 701.

In accordance with a further aspect, a protection member 80, also referred to as boot, is provided to at least partially encapsulate or shield the presenter assembly 702, and particularly the extensible member 722, both while the vehicle door 712 is in the open and closed positions. The boot 80 is shown a generally cylindrical member that surrounds the extensible member 722 to as to provide protection thereto against elements such as dust, water, and other debris/elements that could otherwise degrade the performance of the presenter assembly 702. The boot 80 is shown in a non-limiting example as having an annular flange and/or recess 82 adjacent one end 84 configured for attached fixation to an annular rim or edge 86 of the vehicle body 714, wherein the boot 80 can be simply snapped or received in an interference fit with the vehicle body 714, thereby not requiring secondary fixation fasteners. It is contemplated herein that the boot 80 could be fixed directly to the presenter assembly 702, if desired. The boot 80 can be made of any suitable material, and is preferably made of a flexible, resilient polymeric material, such as rubber or the like. As such, being flexibly resilient, the boot 80 can readily flex as needed, expand lengthwise and contract lengthwise, in response to corresponding movement of the vehicle door 12, 17 as the vehicle door engages an outwardly facing end 88 while in a closed position and moves out of engagement from the end 88 in an open position. To further facilitate lengthwise expansion and contraction, the boot 80 can be formed having a bellowed or convolute wall 90, if desired.

Figure 9A:
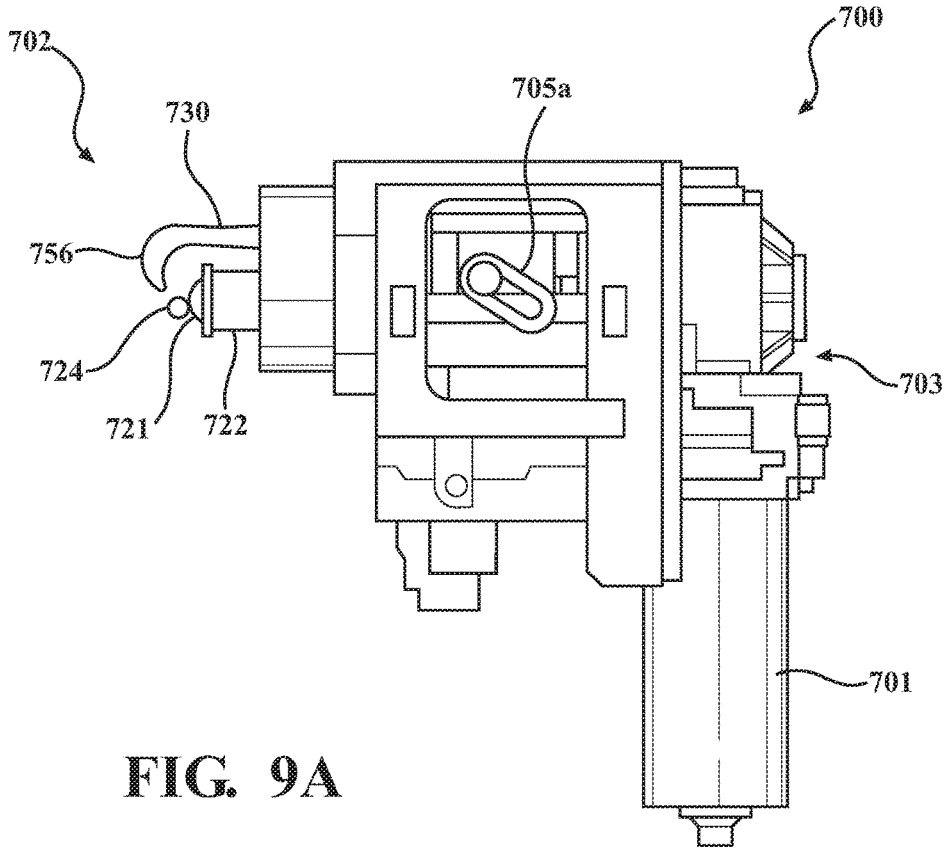
FIG. 9A is an operational view of a presenter assembly of the power door presenter system of FIG. 8 showing the presenter assembly in an initial stage of a door opening sequence.
Figure 9B:
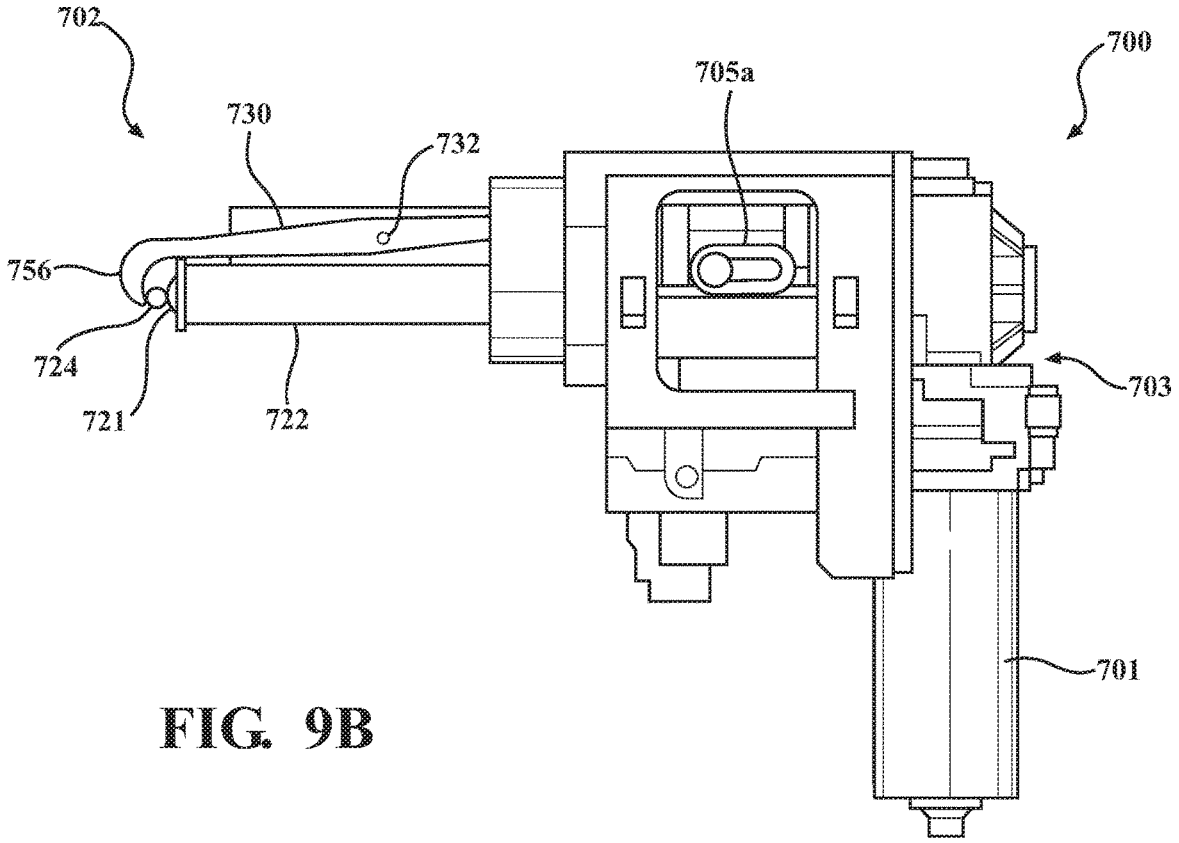
FIG. 9B is a view similar to FIG. 9A showing the presenter assembly in an intermediate stage of the door opening sequence.
Figure 9C:
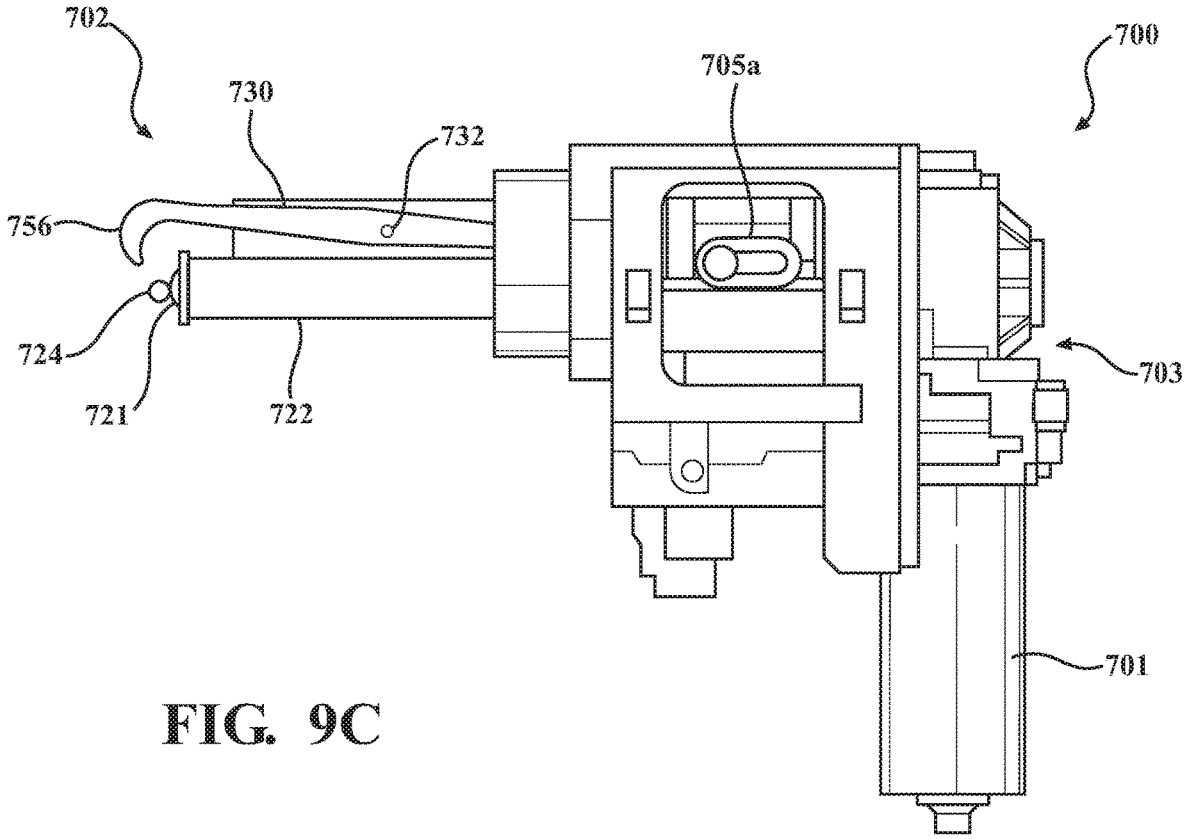
FIG. 9C is a view similar to FIG. 9A showing the presenter assembly in a final stage of the door opening sequence.
Figure 10A:
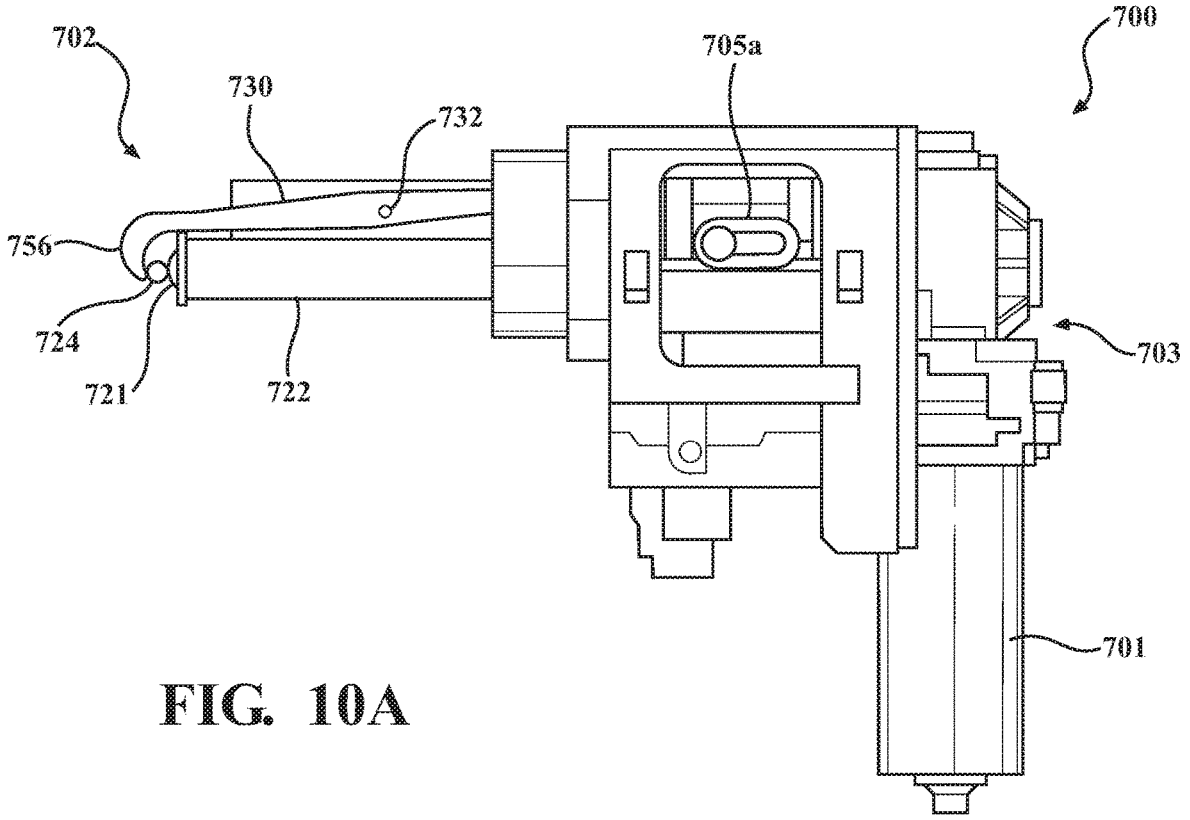
FIG. 10A is an operational view of a presenter assembly of the power door presenter system of FIG. 8 showing the presenter assembly in an initial stage of a door closing sequence.
Figure 10B:
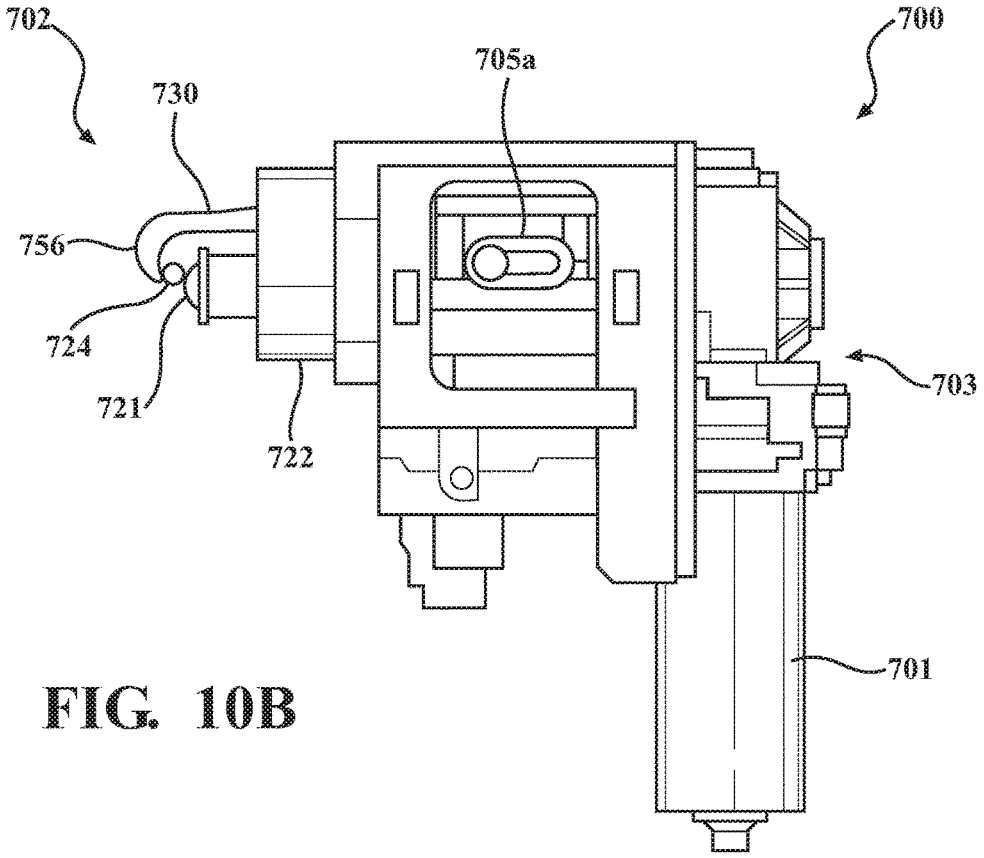
FIG. 10B is a view similar to FIG. 10A showing the presenter assembly in an intermediate stage of the door closing sequence.
Figure 10C:
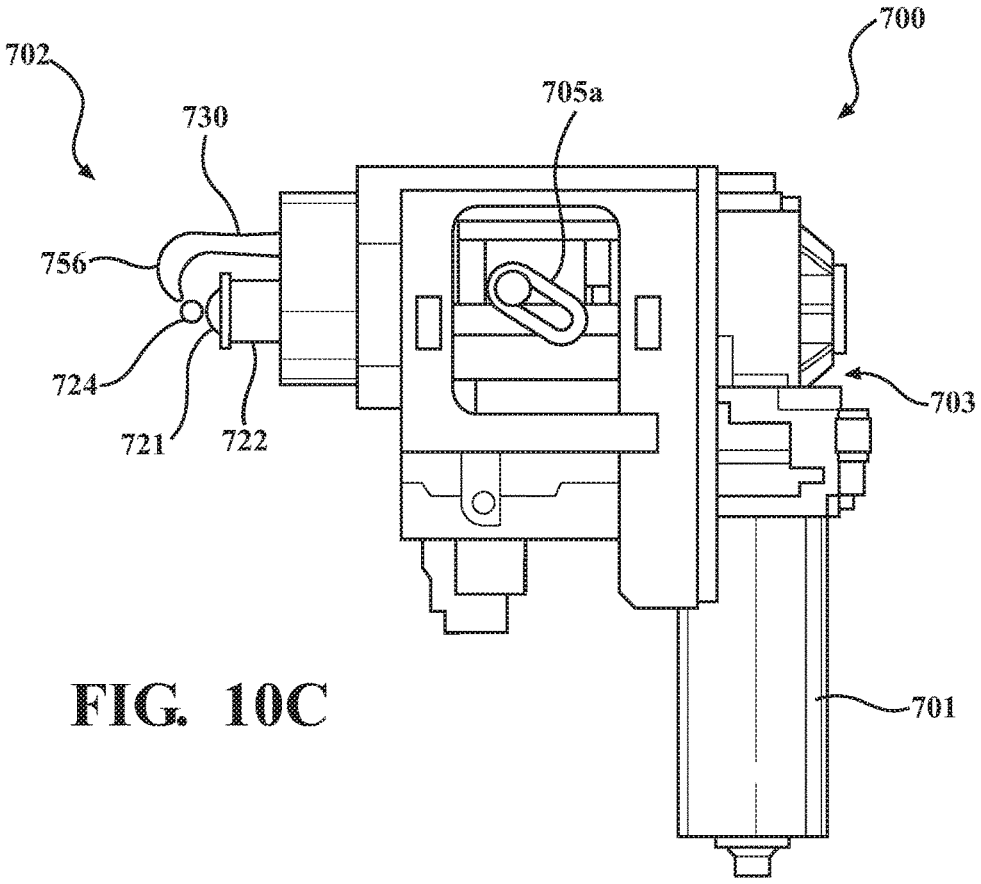
FIG. 10C is a view similar to FIG. 10A showing the presenter assembly in a final stage of the door closing sequence.
Figure 11:
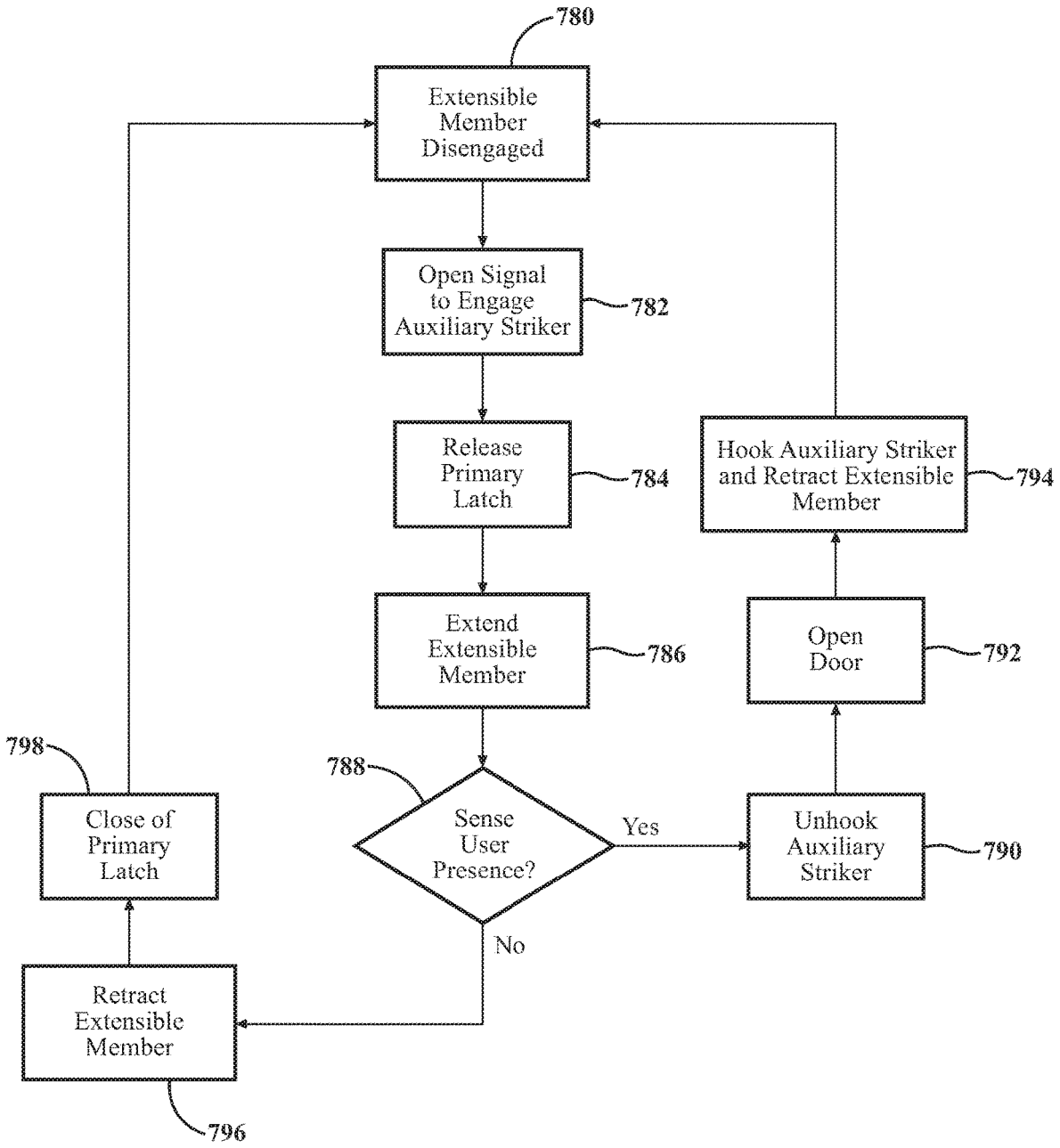
FIG. 11 is a flowchart for operation of the presenter assembly of the power door presenter system of FIG. 8.

Referring to FIGS. 9A-9C and 10A-10C, shown are similar positions respectively to FIGS. 5A-5C and 6A-6C. For example, FIG. 9A is similar to FIG. 5A, FIG. 9B is similar to FIG. 5B (however with latch hook 730 engaged), FIG. 9C is similar to FIG. 5C, FIG. 10A is similar to FIG. 6A, FIG. 10B is similar to FIG. 6B, and FIG. 10C is similar to FIG. 6C.

Referring to FIGS. 2, 8, 9A-9C, 10A-10C, and 11, the power door presenter system 700 at step 780 is in a disengaged state (FIG. 9A, wherein the latch hook 730 is disengaged from the auxiliary striker 724). At step 782, the control module 52 initiates door 12 opening by receiving an open signal (e.g. from key fob 60) and operating the latch hook 730 (e.g. by moving the hook portion 756 of latch hook 730 from an unlatched, disengaged position to a latched, engaged position with the auxiliary striker 724 using a mechanical or electromechanical mechanism (biasing member) such as a solenoid or other actuator 705 (such as a rotary actuator) (FIG. 12) coupled to slotted pivot lever 705*a* which is connected to the latch hook 730 on one side of pivot 732), thereby providing for the extensible member 722 to pivot into connected relation with the auxiliary striker 724 (FIG. 9B, shown extended, but it is to be recognized that the hook portion 756 of latch hook 730 is engaged and latched with the auxiliary striker 724 prior to initiating the extension of extensible member 722) by hooking the auxiliary striker 724 located on door 12 inner sheet metal and to optionally initially extend the extensible member 722 in order to "charge" or otherwise bias the door 12 to open upon unlatching the primary latch 13. It is recognized at this stage that the primary latch 13 remains latched until unlatched at step 784. At step 784, the control module 52 (or other vehicle control module—not shown) can release the primary latch 13 (e.g. move the pawl 23 to the ratchet 21 release position). As a result of the hook portion 756 of latch hook 730 being engaged and latched with the auxiliary striker 724, the striker 37 can remain in fish mouth of the primary latch 13 until the extensible member 722 operably pushes the striker 37 out of the fish mouth of the primary latch 13 during further extension of the extensible member 722 in subsequent steps. At step 786, the control module 52 can receive a signal (e.g. from sensor(s) 71) that the primary latch 13 is unlatched (e.g. door 12 in the released position) and can send a signal to the electric motor 701 to further actuate and axially extend the extensible member 722 in order to "present" the door 12 (e.g. opens the door 12 as equivalent of approximately 50 mm at rear hem flange of the door 12). As part of step 786, once the extensible member 722 begins extending, with the latch hook 730 remaining latched with the auxiliary striker 724, the primary latch 13 can send a signal (e.g. via the external door open switch 63) to the control unit 52 indicating that the ratchet 21 has rotated to the open position and the striker 37 is free from the primary latch 13. As a result, the control unit 52 can send a signal to the primary latch 13 to reset the power release motor of the primary patch 13 in order to facilitate movement of the pawl 23 to return to the ratchet locking position. Also, at this time, the control unit 52 can start polling sensor(s) 71 (e.g. Adjustable Pressure Switch (APS) 71 or other sensing technology 71) for manual opening of the door 12 by the user and thereby continue checking throughout the extension of the extensible member 722.

At step 788, if the presence of the user is sensed by the sensor(s) 71, e.g. user inserts hand behind hem flange and presence of the user's hand is detected via pressure on the APS 71 or other sensing technology 71, the control module 52 sends a signal at step 790 to unlatch the hook portion 756 of latch hook 730 from the auxiliary striker 724 (FIG. 9C) on door 12 (e.g. at any point during opening when the APS is activated). Once the latch hook 730 is moved to its unlatched position, the user can manually open the door 12 at step 792 to a desired door check position and the control module 52, at step 794, the control module 52 sends a signal to the electric motor 701 to retract the extensible member 722 back to the home position (FIG. 9A, though auxiliary striker 724 would not be present), with the hook portion 756 in the release position, as the user is manually opening the door 12.

Figure 13:
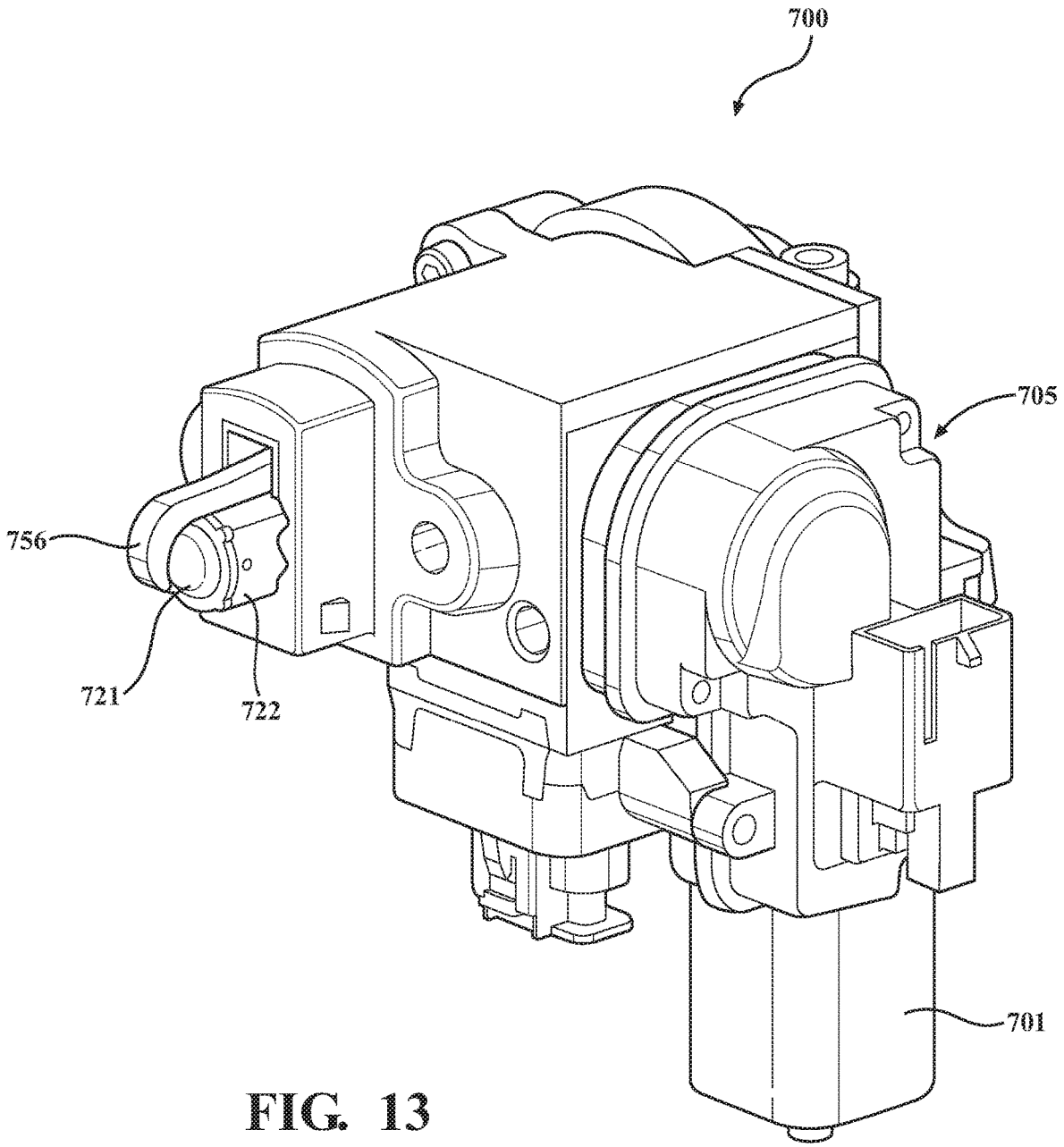
FIG. 13 provides a further view of the power door presenter system of FIG. 12.

At step 794, once the door 12 reaches a position where the primary latch 13 can be operated (e.g. the striker 37 reaches the secondary latch position as sensed and reported to the control module 52 by one or more sensor(s) 71 of the primary latch 13, the power door presenter system 700, and/or the door 12), the control module 52 sends a signal to the latch hook 730 to unlatch (e.g. via operation of actuator 705 shown in FIG. 13) from the striker 724 and the control module 52 sends a signal to the actuator 705 to complete retracting of the extensible member 722 to the full home position prior to the primary latch 13 cinching or otherwise the signal is sent to the latch hook 730 to unlatch once the extensible member 722 reaches a position where the door 12 is fully closed in the case without cinch. It is recognized that the control module 52 can poll for signal(s) generated by the sensor(s) 71 (e.g. the APS (or other sensor technology) located on the hem flange of the door 12) and can send an interrupt signal to the control module 52 in order to stop operation of the extensible member 722 during the retraction and closing operation of the door 12 (to facilitate protection of the user). Upon closing of the door 12 by the extensible member 722, in order to close the primary latch 13 (to either the primary position, or secondary position if the latch 13 is cinch enabled), the striker 724 would once again become positioned at step 780 adjacent to the extensible member 722 to resemble as shown in FIG. 9A. Accordingly, the power door presenter system 700 is ready for reactivation at step 780.

If at step 788, the user does not open the door 12 manually after a pre-set time (i.e. the sensor(s) 71 do not detect the presence of the user and/or the user is not sensed as having taken manual control of the door 12), the control module 52 does not change the state of the latch hook 730, and thus, the latch hook 730 remains hooked/latched with the striker 724 (FIG. 10A), and the control module 52 sends a retract signal to the electric motor 701 in order to have the extensible member 722 and the latch hook 730 retracted pulling the striker 724 back towards the home position (see FIG. 10B). As such, if at step 788 no signal (e.g. no change of state) is received, then the control module 52 at step 788 maintains engagement of the latch hook 730 with the striker 724, and signals at step 796 the electric motor 701 to retract the extensible member 722 (while the latch hook 730 and striker 724 are engaged with one another) in order to pull the door 12 to the secondary latch position, for example. At step 798, the primary latch 13 is engaged by the user and/or by the vehicle electronic systems (in the case of a primary latch 13) and the door 12 is returned to the primary closed position and disengagement of the latch hook 730 with the striker 724 is performed by the control module 52 to place the power swing door actuation system 700 in the state of disengagement of step 780 (FIG. 10C). Accordingly, the power swing door actuation system 700 is ready for reactivation at step 782.

As discussed above, for inside operation of the primary latch 13 (e.g. using interior door handles 61*a* by the user), activation of an inside handle switch 63*a* (e.g. by the user) releases the primary latch 13 while the latch hook 730 remains disengaged from the striker at step 780. As such, from the inside, the user opens door 12 like a conventional door (i.e. without involvement of the power door presenter system 600), as the door 12 presenter function of the extensible member 722 is not used. In terms of manual closing of the door 12, the user manually closes door 12 to secondary latch position (or slams to primary), in order for the primary latch 13 to lock the door 12 (e.g. the primary latch 13 embodied as an e-latch cinches to primary latch 13 to the primary latched position).

As discussed above, the operation of the power door presenter system 700 provides for one or more of the capabilities of: utilizing a pre-activation pulse (e.g. of 200 ms) before primary latch 13 release occurs in order to engage between the latch hook 730 and the striker 724 (if needed); optionally preload or initially extend the extensible member 722 such that the extensible member 722 is biased against the striker 724 for opening of the door 12; primary latch 13 can be released before the extensible member 722 is extended further (e.g. e-latch release motor is turned on before further extension of the extensible member 722 occurs); movement of the extensible member 722 towards the extended position (to await for manual control of the user via APS sensing 71 or the equivalent) can provide for movement of the striker 37 within the fish mouth of the primary latch 13; once the latch open switch 71 transitions to latch full open for the primary latch 13, the extensible member 722 can extend to full open, where the door 12 rear hem flange can be approximately 5 mm from the vehicle body, by example only, and wait for manual control of the door 12 by the user (via APS sensing 71 or the equivalent). Otherwise after a timer expires the retract sequence of the extensible member 722 occurs in order to pull the door 12 back towards the closed position.

Figure 12:
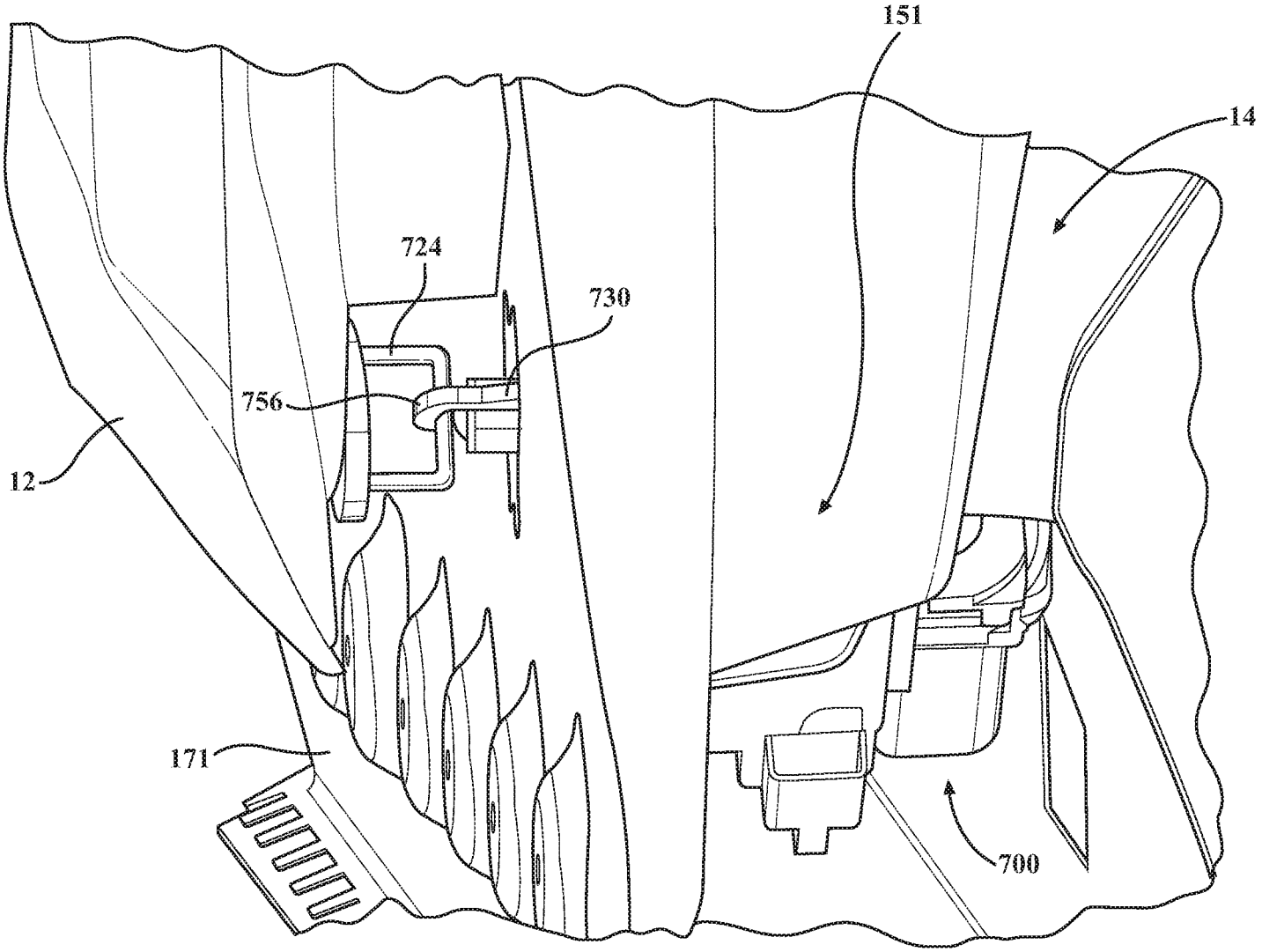
FIG. 12 is an example enlarged view of the presenter assembly associated with the power door present system of FIG. 2.

Referring to FIG. 12, a non-limiting embodiment of the power door presenter system 700 is shown positioned with respect to a rear body pillar 151 of the vehicle 10, such that the striker 724 is positioned on a distal end of the door 12 near the rear hem flange and opposite the hinges 16, 18 (FIG. 2). Shown in FIG. 12 is the latch hook 730 engaged with the striker 724, thus reflecting the door 12 position as shown in FIG. 9B. The power door presenter system 700 may be installed through a seat belt retractor opening in the body 14 prior to the seat belt retractor installation.

The power swing door presenter systems shown can provide an arrangement for providing a secondary or auxiliary latch mechanism that is operable to maintain a latched relationship between the vehicle body 14 and the vehicle door 12 upon actuation of the door presenter unit as the door moves from its closed position to its deployed position. The auxiliary latch mechanism is subsequently released to permit movement of the door from its deployed position to its fully open position. While not limited thereto, the door presenter and auxiliary latch system is capable of providing a range of swinging deployment of about 30-50 mm to meet current door system requirements. In addition, prior to release of the auxiliary latch mechanism, the presenter unit can be retracted from its deployed position to automatically return the door to its closed position (fully closed position or a secondary closed position if the primary latch includes a cinch function). Additionally, the auxiliary latch mechanisms are configured to automatically re-engage the presented (i.e. re-latch) upon closing of the vehicle door.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure. Those skilled in the art will recognize that concepts disclosed in association with the example detection system can likewise be implemented into many other systems to control one or more operations and/or functions.

Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

The terminology used herein is for the purpose of describing particular example embodiments only and is not intended to be limiting. As used herein, the singular forms "a," "an," and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on," "engaged to," "connected to," or "coupled to" another element or layer, it may be directly on, engaged, connected or coupled to the other element or layer, or intervening elements or layers may be present. In contrast, when an element is referred to as being "directly on," "directly engaged to," "directly connected to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath," "below," "lower," "above," "upper," "top", "bottom", and the like, may be used herein for ease of description to describe one element's or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated degrees or at other orientations) and the spatially relative descriptions used herein interpreted accordingly.

What is claimed is:

1. A power door presenter system for pivoting a vehicle door relative to a vehicle body between a closed position and a partially open deployed position, comprising:

a presenter assembly having a housing mounted to one of the vehicle body and the vehicle door and having an extensible member and an actuator for actuating powered movement of the extensible member between a retracted position corresponding to the closed position of the vehicle door and an extended position corresponding to the partially open deployed position of the vehicle door, said presenter assembly having an auxiliary latch mechanism moveable between latched and unlatched positions;

an auxiliary latch striker fixed to the other one of the vehicle body and the vehicle door, the auxiliary latch striker being configured to be latched with said auxiliary latch mechanism when said auxiliary latch mechanism is in said latched position and the vehicle door is in the partially open deployed position and unlatched from said auxiliary latch mechanism when said auxiliary latch mechanism is in said unlatched position, wherein said auxiliary latch mechanism is unlatched from said auxiliary latch striker when the vehicle door is under manual control of a user, so as to permit the user to move the door from the partially open deployed position to a fully open position, and said auxiliary latch mechanism is selectively operable to be latched with said auxiliary latch striker when the vehicle door is not under said manual control of the user and is in the partially open deployed position, so as to permit movement of the door from the partially open deployed position to the closed position via movement of the extensible member to the retracted position;

wherein said auxiliary latch mechanism is operable to remain in said unlatched position, unlatched from said auxiliary latch striker during the powered movement of said extensible member between said retracted and extended positions and is further operable to be moved to said latched position into engagement with said auxiliary latch striker when the vehicle door is in the partially open deployed position, so as to permit the presenter assembly to move the door to the closed position;

wherein said auxiliary latch mechanism is pivotally connected to said extensible member for pivotal movement between said latched and unlatched positions, and further including a biasing member releasably maintaining said auxiliary latch mechanism in one of said latched and unlatched positions; and wherein said auxiliary latch mechanism includes at least one auxiliary member abutment surface and said housing includes at least one presenter abutment surface, said at least one auxiliary member abutment surface being configured for selective abutment with said at least one presenter abutment surface to pivot said auxiliary latch mechanism from said latched position to said unlatched position.

2. The power door presenter system of claim 1, wherein said auxiliary latch mechanism is operable to remain in said latched position in said engagement with said auxiliary latch striker during the powered movement of said extensible member between said retracted and extended positions and is further operable to be moved to said unlatched position and unlatched from said auxiliary latch striker when the vehicle door is under said manual control of the user.

3. The power door presenter system of claim 2, further including a control module in operable communication with said presenter assembly, said control module being configured to receive a signal from a sensor and to provide a signal to said presenter assembly indicating the vehicle door is under the manual control of the user to release said auxiliary latch mechanism from the latched position in said engagement with said auxiliary latch striker.

4. The power door presenter system of claim 3, wherein said auxiliary latch mechanism is configured to remain in the latched position in said engagement with said auxiliary latch striker while the door is in the partially open deployed position in the absence of receiving the signal from said control module indicating the vehicle door is under the manual control of the user.

5. The power door presenter system of claim 4, wherein said control module is operable to send a signal to said presenter assembly to cause said actuator to move said extensible member from said extended position to said retracted position while said auxiliary latch mechanism is in the latched position in said engagement with said auxiliary latch striker to move the door from the partially open deployed position to the closed position.

6. The power door presenter system of claim 1, wherein said at least one presenter abutment surface comprises first and second presenter abutment surfaces and said at least one auxiliary member abutment surface comprises first and second auxiliary member abutment surfaces, said first presenter abutment surface being configured to abut said first auxiliary member abutment surface to pivot said auxiliary latch mechanism from said latched position to said unlatched position as said extensible member is moved into said retracted position and said second presenter abutment surface being configured to abut said second auxiliary member abutment surface to pivot said auxiliary latch mechanism from said unlatched position to said latched position as said extensible member is moved into said extended position.

7. The power door presenter system of claim 1, wherein said presenter assembly is mounted on the vehicle body and the auxiliary latch striker is mounted on the door.

8. A power door presenter system for pivoting a vehicle door relative to a vehicle body between a closed position and a partially open deployed position, comprising:

a presenter assembly having a housing mounted to one of the vehicle body and the vehicle door and having an extensible member and an actuator for actuating movement of the extensible member between retracted and extended positions;

an auxiliary latch striker fixed to the other one of the vehicle body and the vehicle door, the auxiliary latch striker being unlatched from the presenter assembly during powered movement of the door from the closed position to the partially open deployed position; and an auxiliary latch mechanism operable for selective engagement with the auxiliary latch striker when the vehicle door is in the partially open deployed position, so as to enable automated movement of the door from the partially open deployed position to the closed position during selective actuation of said actuator and corresponding movement of said extensible member from said extended position to said retracted position;

wherein said auxiliary latch mechanism is an elongate member pivotally connected to said extensible member for pivotal movement between a latched position latched with said auxiliary latch striker and an unlatched position unlatched from said auxiliary latch striker, and further including a biasing member releasably maintaining said auxiliary latch mechanism in one of said latched and unlatched positions; and wherein said auxiliary latch mechanism includes at least one auxiliary member abutment surface and said housing includes at least one presenter abutment surface, said at least one auxiliary member abutment surface being configured for selective abutment with said at least one presenter abutment surface to pivot said auxiliary latch mechanism from said unlatched position to said latched position.

9. The power door presenter system of claim 8, wherein said at least one presenter abutment surface comprises first and second presenter abutment surfaces and said at least one auxiliary member abutment surface includes first and second auxiliary member abutment surfaces, said first presenter abutment surface being configured to abut said first auxiliary member abutment surface to pivot said auxiliary latch mechanism from said latched position to said unlatched position as said extensible member moves into said retracted position and said second presenter abutment surface being configured to abut said second auxiliary member abutment surface to pivot said auxiliary latch mechanism from said unlatched position to said latched position as said extensible member moves into said extended position.

10. The power door presenter system of claim 8, wherein said presenter assembly is mounted on the vehicle body and the auxiliary latch striker is mounted on the door.

* * * * *